US009565929B2

(12) United States Patent
Flannery et al.

(10) Patent No.: US 9,565,929 B2
(45) Date of Patent: Feb. 14, 2017

(54) DINE AND DRAW CHILD LAP TRAY APPARATUS

(71) Applicant: Regalo International, LLC, Longboat Key, FL (US)

(72) Inventors: Mark A. Flannery, Longboat Key, FL (US); Brian G. Linehan, Burnsville, MN (US); Elizabeth R. Volk, Saint Paul, MN (US)

(73) Assignee: Regalo International, LLC, Longboat Key, FL (US)

( * ) Notice: Subject to any disclaimer, the term of this patent is extended or adjusted under 35 U.S.C. 154(b) by 0 days.

(21) Appl. No.: 14/514,339

(22) Filed: Oct. 14, 2014

(65) Prior Publication Data

US 2015/0108123 A1 Apr. 23, 2015

Related U.S. Application Data

(60) Provisional application No. 61/892,331, filed on Oct. 17, 2013.

(51) Int. Cl.

| | |
|---|---|
| ***A47B 23/00*** | (2006.01) |
| ***A47B 37/00*** | (2006.01) |
| ***A47D 3/00*** | (2006.01) |
| *A47D 1/00* | (2006.01) |
| *A47G 23/06* | (2006.01) |

(52) U.S. Cl.

CPC ..... *A47B 23/002* (2013.01); *A47D 3/00* (2013.01); *A47D 1/008* (2013.01); *A47G 23/0608* (2013.01)

(58) Field of Classification Search

CPC ..... A47D 3/00; A47D 1/008; A47B 23/002; A47G 23/06; A47G 23/0608

See application file for complete search history.

(56) References Cited

U.S. PATENT DOCUMENTS

| | | | | | |
|---|---|---|---|---|---|
| 2,058,931 | A | * | 10/1936 | Williams | A44B 11/04 24/200 |
| D179,534 | S | * | 1/1957 | Bullock | D19/92 |
| 4,052,944 | A | | 10/1977 | Jennings | |
| 4,312,507 | A | | 1/1982 | Smith et al. | |
| D288,513 | S | * | 3/1987 | Shelly | D6/707.16 |
| 4,700,634 | A | * | 10/1987 | Mills | A47B 23/002 108/43 |
| 4,838,444 | A | * | 6/1989 | Bitel | B65D 1/36 206/518 |
| 5,134,930 | A | * | 8/1992 | Mei-Hwa | A47B 23/00 100/42 |
| D358,730 | S | * | 5/1995 | Meeker | D6/707.16 |
| 5,460,102 | A | * | 10/1995 | Pasmanick | A47B 23/002 108/25 |
| 5,527,090 | A | * | 6/1996 | Cone, II | A47D 1/008 297/149 |

(Continued)

*Primary Examiner* — Daniel J Troy
*Assistant Examiner* — Andres Gallego

(57) ABSTRACT

A two-part tray apparatus that includes a base tray having a desk surface for drawing and writing and a food tray having four food compartments. A resilient bottom of the base tray may rest on a lap. The food tray is nestable into the base tray and is nonslideable relative to the base tray. The base tray includes a proximal side with no upwardly extending walls to make it easy for a child to write or draw on the desk surface. Strap units are included to anchor opposite ends of the tray apparatus or may be connected to each other to form a full length shoulder strap.

9 Claims, 12 Drawing Sheets

(56) References Cited

U.S. PATENT DOCUMENTS

| | | | | |
|---|---|---|---|---|
| 5,720,226 | A | 2/1998 | Padovano | |
| 5,732,849 | A * | 3/1998 | Brooks | A47G 23/0608 220/17.1 |
| 5,862,933 | A * | 1/1999 | Neville | A47B 23/002 108/43 |
| 5,915,561 | A * | 6/1999 | Lorenzana | A47G 23/0608 206/562 |
| 6,036,020 | A * | 3/2000 | Distler | A47G 23/06 206/217 |
| 6,163,450 | A * | 12/2000 | Kim | G06F 1/1616 174/50 |
| 6,663,072 | B1 * | 12/2003 | Ritchey | A45C 3/02 248/346.03 |
| 6,920,830 | B1 * | 7/2005 | Asbach | A47D 1/008 108/26 |
| 6,986,308 | B1 * | 1/2006 | King | A47G 23/0608 108/25 |
| 6,995,977 | B2 * | 2/2006 | Yang | A45C 13/30 24/649 |
| 7,134,714 | B1 * | 11/2006 | Connery | A47D 1/008 248/311.2 |
| 2005/0126445 | A1 | 6/2005 | Guard et al. | |
| 2007/0113757 | A1 * | 5/2007 | Lilly | A47G 23/0608 108/25 |
| 2007/0220717 | A1 * | 9/2007 | Brinson | A41F 19/00 24/298 |
| 2009/0206638 | A1 * | 8/2009 | Hartenstine | A47D 1/002 297/149 |
| 2010/0181808 | A1 * | 7/2010 | Medeiros | A47D 1/002 297/135 |
| 2014/0070061 | A1 * | 3/2014 | Tsai | A47D 1/008 248/205.1 |

* cited by examiner

FIG. 10C
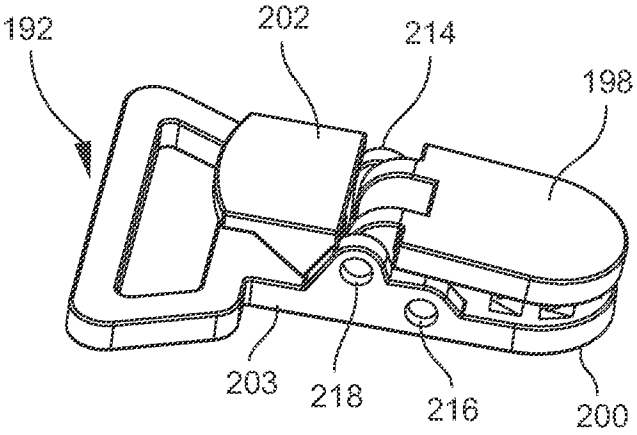
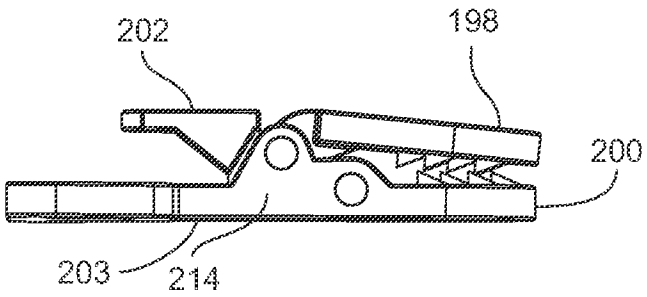
FIG. 10D
FIG. 10A
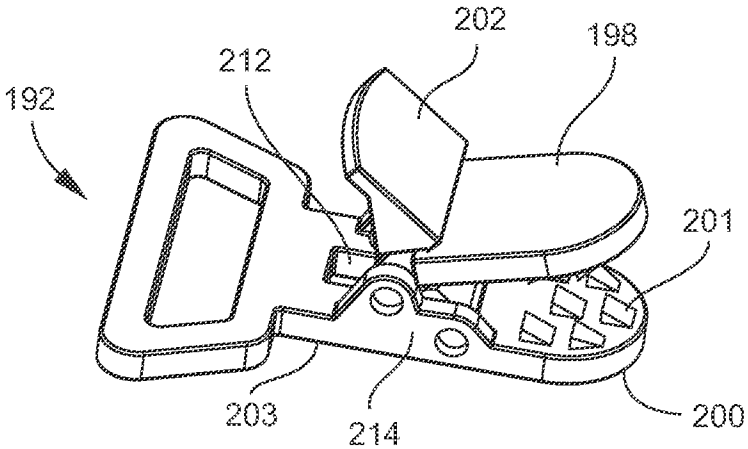
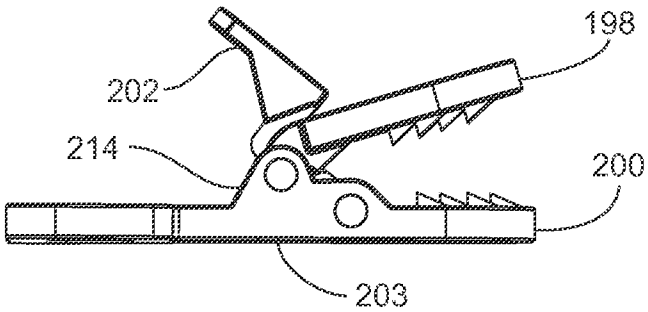
FIG. 10B

DINE AND DRAW CHILD LAP TRAY APPARATUS

This application claims the benefit under 35 U.S.C. 119(e) of U.S. Provisional Patent Application No. 61/892,331 filed Oct. 17, 2013, which is hereby incorporated by reference in its entirety into this application.

FIELD OF THE INVENTION

The present invention relates to a multi-purpose tray apparatus, more particularly to a lap tray apparatus, and specifically to a lap tray apparatus having a base tray with a desk surface and a food tray having food compartments and nestable in the base tray.

BACKGROUND OF THE INVENTION

A child may sit for an extended period of time. For example, a car trip across town in rush hour traffic may take over an hour. Across country on a camping trip, a child may sit in a car seat for an entire morning or afternoon. During these trips, a child may snack, have a full meal to eat, draw, play with toys, read a book, or engage in some other activity.

Besides riding in a car, a parent and child may take a bus, fly on an airplane, or catch a train in a metro transit system. With these modes of transportation too, the parent may acquire a knack for keeping his or her child interested and engaged in an activity when the child is seated.

Even at home, a child may be required to sit, in his or her mind especially, for long periods. Such a child may be enticed to stay seated at one location for a longer period of time with a set of crayons and paper, a book, dolls or toy cars.

When a parent uses a highchair tray to place on the lap of a child, neither the top structure nor the bottom structure of the highchair tray meets the needs of the parent. For example, the top structure of the highchair tray will likely have food compartments only, with little flat area on which to draw or write. These tiny food compartments may also hinder playing with LEGOS® or pushing toy cars. The bottom structure of the high chair tray is likely configured to engage a high chair and have no ergonomic form to fit the lap of a child.

SUMMARY OF THE INVENTION

A feature of the present invention is a tray apparatus for children having a base tray for an activity such as drawing.

Another feature of the present invention is a tray apparatus having a food tray for dining.

Another feature of the present invention is tray apparatus having, in combination, a base tray for an activity such as drawing and a food tray for dining.

Another feature of the present invention is a two-part tray.

Another feature of the present invention is a lap tray.

Another feature of the present invention is the provision in a tray apparatus, of a base tray having a desk surface extending generally between proximal and distal sides and between the right and left sides.

Another feature of the present invention is the provision in a tray apparatus, of a food tray covering at least a portion of the top side of the base tray and being engagable to and disengagable from the base tray, the food tray including at least two compartments separated from each other by an inner wall and each of the compartments having a depth.

Another feature of the present invention is the provision in a tray apparatus, of a bottom side of a base tray having a resilient material that fits comfortably on a lap of a child where the resilient material is compressible by a human hand.

Another feature of the present invention is the provision in a tray apparatus, of a top side of a base tray being formed of a molded plastic material where the molded plastic material is noncompressible by a human hand.

Another feature of the present invention is the provision in a tray apparatus, of resilient material on a bottom side of a base tray including a depression to ergonomically receive a lap of a child where the depression extends toward a top side of the base tray.

Another feature of the present invention is the provision in a tray apparatus, of top and bottom sides of a base tray being one-piece with each other and being inseparable from each other without destroying an integrity of the base tray.

Another feature of the present invention is the provision in a tray apparatus, of a food tray including a proximal side and a distal side, where each of the proximal sides of the base tray and food tray includes an inwardly extending section for an ergonomic fit for a child, where the inwardly extending section of the base tray extends toward the distal side of the base tray, and where the inwardly extending section of the food tray extends toward the distal side of the food tray.

Another feature of the present invention is the provision in a tray apparatus, of a base tray having a desk surface for an activity such as drawing, coloring, writing, reading or another hand activity such as playing with hand and finger toys such as LEGOS®.

Another feature of the present invention is the provision in a tray apparatus, of a base tray having a proximal side, a distal side opposing the proximal side, a left side, a right side opposing the left side, a top side, and a bottom side opposing the top side, of the top side having the desk surface, and of a food tray nestable into the top side of the base tray.

Another feature of the present invention is the provision in a tray apparatus, of the desk surface of the base tray bounded by a first wall running along at least a portion of the left side, at least a portion of the right side, and at least a portion of the distal side, where the first wall includes a desk opening along the proximal side such that the desk surface is open along at least a portion of the proximal side to render the desk surface accessible for hands and forearms of a user.

Another feature of the present invention is the provision in a tray apparatus, of a food tray, where the food tray covers at least a portion of the top side of the base tray, and where the food tray includes at least two compartments separated from each other by an inner wall.

Another feature of the present invention is the provision in a tray apparatus, of a food tray having a proximal wall confronting the proximal side of the base tray, where the proximal wall of the food tray closes off at least a portion of the desk opening to minimize contents of the food tray from spilling out of the food tray and onto a lap of a child.

Another feature of the present invention is the provision in a tray apparatus, of the base tray including a receptacle, where the receptacle is separated from the desk surface by a receptacle wall, and where the receptacle includes a receptacle opening that remains accessible when the food tray is on the base tray.

Another feature of the present invention is the provision in a tray apparatus, of a base tray having a desk surface that includes a depth and of a receptacle that includes a depth, where the depth of the receptacle is greater than the depth of the desk surface.

Another feature of the present invention is the provision in a tray apparatus, of a base tray that includes a receiver portion that is dovetailed shaped, and of a food tray that includes an insert portion that is dovetailed shape that nestles into the receiver portion of the base tray such that the food tray is locked against horizontal sliding relative to the base tray such that the food tray is removed in a vertical fashion from the base tray.

Another feature of the present invention is the provision in a tray apparatus, of a base tray that includes a receiver portion having a neck and a head, and of a food tray that includes an insert portion having a neck and a head that nestles into the head and neck of the receiver portion of the base tray such that the food tray is locked against horizontal sliding relative to the base tray such that the food tray is removed in a vertical fashion from the base tray.

Another feature of the present invention is the provision in a tray apparatus, of a proximal side of a base tray and a desk surface of the base tray forming a junction, and of a depth of the junction being at or greater than a depth of the desk surface such that the desk surface leads into the proximal side of the base tray.

Another feature of the present invention is the provision in a tray apparatus, of a base tray with a desk surface, and of the desk surface defining a generally horizontal plane.

Another feature of the present invention is the provision in a tray apparatus, of a base tray having a desk surface having a depth relative to a top of a first wall that runs along at least a portion of the periphery of the base tray, of the base tray having a first receptacle where the first receptacle is separated from the desk surface by a first receptacle wall, where the first receptacle has a depth relative to the top of the first wall, and where the depth of the first receptacle is greater than the depth of the desk surface, and of the base tray having a second receptacle where the second receptacle is separated from the desk surface by a second receptacle wall, where the second receptacle has a depth relative to the top of the first wall, and where the depth of the second receptacle is greater than the depth of the desk surface.

Another feature of the present invention is the provision in a tray apparatus, of a food tray having a peripheral lip extending about the periphery of the food tray, where the peripheral lip runs adjacent to at least a portion of the first wall on the left side of the base tray, at least a portion of the first receptacle wall, at least a portion of the first wall on the distal side of the base tray, at least a portion of the second receptacle wall, at least a portion of the first wall on the right side of the base tray, and at least a portion of the proximal side of the base tray.

Another feature of the present invention is the provision in a tray apparatus, of first and second receptacles on the base tray remaining exposed and accessible for use when the food tray is on the base tray.

Another feature of the present invention is the provision in a tray apparatus, of a food tray having a peripheral lip, where the peripheral lip runs sequentially from said portion of the first wall on the left side of the base tray, to said portion of the first receptacle wall, to said portion of the first wall on the distal side of the base tray, to said portion of the second receptacle wall, to said portion of the first wall on the right side of the base tray, to said portion of the proximal side of the base tray, and back to said portion of the first wall on the left side of the base tray.

Another feature of the present invention is the provision in a tray apparatus, of a food tray that in total includes first, second, third and fourth compartments, where the first compartment is between the first and second receptacles and further is between the second compartment and the distal side of the base tray when the food tray is in the base tray, where the second compartment is between the first compartment and the proximal side of the base and further is between the third and fourth compartment when the food tray is in the base tray, where the third compartment is between the first receptacle and the proximal side of the base tray and further is between the first wall of the base tray and the second compartment when the food tray is in the base tray, and where the fourth compartment is between the second receptacle and the proximal side of the base tray and further is between the first wall of the base tray and the second compartment when the food tray is in the base tray.

Another feature of the present invention is the provision in a tray apparatus, of a strap apparatus for carrying the base tray and food tray when the food tray is nested into the base tray, where the strap apparatus includes first and second strap units, and where each of the first and second strap units includes first and second ends and an intermediate section between the first and second ends.

Another feature of the present invention is the provision in a tray apparatus, of a strap unit of a strap apparatus having a first end with a removable connector for removable connection to the base tray.

Another feature of the present invention is the provision in a tray apparatus, of a strap unit of a strap apparatus having a second end with a fabric hook and loop fastener.

Another feature of the present invention is the provision in a tray apparatus, of a strap unit of a strap apparatus having an intermediate section having a clip extending therefrom.

Another feature of the present invention is the provision in a tray apparatus, of a strap unit of a strap apparatus connecting to a first end of the base tray such that the first strap unit can be anchored at a first location by a clip of the first strap unit to thereby anchor the first end of the base tray.

Another feature of the present invention is the provision in a tray apparatus, of a strap unit of a strap apparatus connecting to a second end of the base tray such that the second strap unit can be anchored at a second location by the clip of the second strap unit to thereby anchor the second end of the base tray.

Another feature of the present invention is the provision in a tray apparatus, of one of the fabric hook and loop fasteners of the first strap unit being connected to one of the fabric hook and loop fasteners of the second strap unit, when the clips of the first and second strap unit are not used, such that the first and second strap units together form a generally U-shaped strap that may be hooked over a shoulder of a caregiver such that the base tray and food tray may be carried when the food tray is nested into the base tray.

An advantage of the present invention is comfort without sacrificing an eating or playing surface. A feature contributing to this advantage is the resilient material on a bottom side of the base tray and, at the same time, a first hard plastic surface on the top side of the base tray for drawing and a second hard plastic surface engagable to the first hard plastic surface.

Another advantage of the present invention is that the base tray includes a desk surface that is easily accessible to the hands and forearms. One feature contributing to this advantage is that the base tray includes no upwardly extending wall or other barrier along essentially the entire proximal edge of the base tray such that the desk surface is open to the hands and forearms. The proximal edge of the base tray is the edge of the base tray that is positioned closest to the torso or chest or stomach when the tray apparatus is on or near the lap of the user.

Another advantage of the present invention is that the base tray and food tray are nonslideable relative to each other when the food tray nests in the base tray. One feature contributing to this advantage is the base tray having a receiver portion shaped with a neck and head and the food tray having an insert portion shaped with a neck and a head and nestable in the insert portion of the base tray.

Another advantage of the present invention is that the surface area of the food tray is minimized. For example, the base tray includes a pair of receptacles for cups or glasses, for pens or pencils, for dry cereal, or for any other article. Each of the receptacles takes generally the shape of a cylindrical depression in the base tray. Neither of the receptacles is covered up when the food tray is nested on the base tray. In the mode where the food tray is used with the base tray, and also in the mode where the base tray is used by itself without the food tray, one or more of the receptacles of the base tray are functional and accessible such that these receptacles may hold a drinking cup or glass.

Another advantage of the present invention is a multi-purpose strap apparatus. Strap units anchor the ends of the tray apparatus to the seat or to the seat environment where the child sits. These same strap units are connectable to each other to form a carrying strap that may be hooked over the shoulder of a caretaker to render the tray apparatus portable.

Another advantage of the present invention is that the multi-purpose strap apparatus employs clips that minimize accidental pinching. The clips have cam mechanisms instead of springs because a spring based clip may, once opened, slip from a child's finger and shut automatically, perhaps pinching a finger.

Another advantage of the present invention is that the food tray complements the base tray. For example, the food tray includes a proximal lip that extends along the proximal edge of the base tray to close off the desk opening of the base tray.

Another advantage of the present invention is that essentially a single tray may be utilized for two different purposes where one purpose is related to food and eating and where another purpose is related to drawing, writing, desk work, or playing with toys on a flat surface.

Another advantage of the present invention is that the food tray is relatively light in weight and yet stable. The stability is provided by the food tray nesting in the base tray. The stability is also provided by the base tray having sufficient mass to remain stable and having straps such that each of the ends may be anchored to further make the tray apparatus as a whole steady and stable and to minimize wobble. In short, when the food tray is nestled into the base tray, the base tray lends its mass and anchored ends to the food tray to make stable an otherwise light in weight food tray.

Another advantage of the present invention is that the food tray is relatively light and includes relatively little mass so as to minimize any weight added to the tray apparatus as a whole.

Another advantage of the present invention is that the food tray is dishwasher safe. The food tray is formed of a plastic that will not melt or deform in the hot waters of a dishwasher.

BRIEF DESCRIPTION OF THE DRAWINGS

FIG. 10A is a perspective view of a clip of the strap unit of FIGS. 9A and 9B in an open position.

FIG. 10B is a side view of the clip of FIG. 10A in an open position.

FIG. 10C is a perspective view of the clip of FIG. 10A in a closed position.

FIG. 10D is a side view of the clip of FIG. 10C in a closed position.

DESCRIPTION

Figure 1:
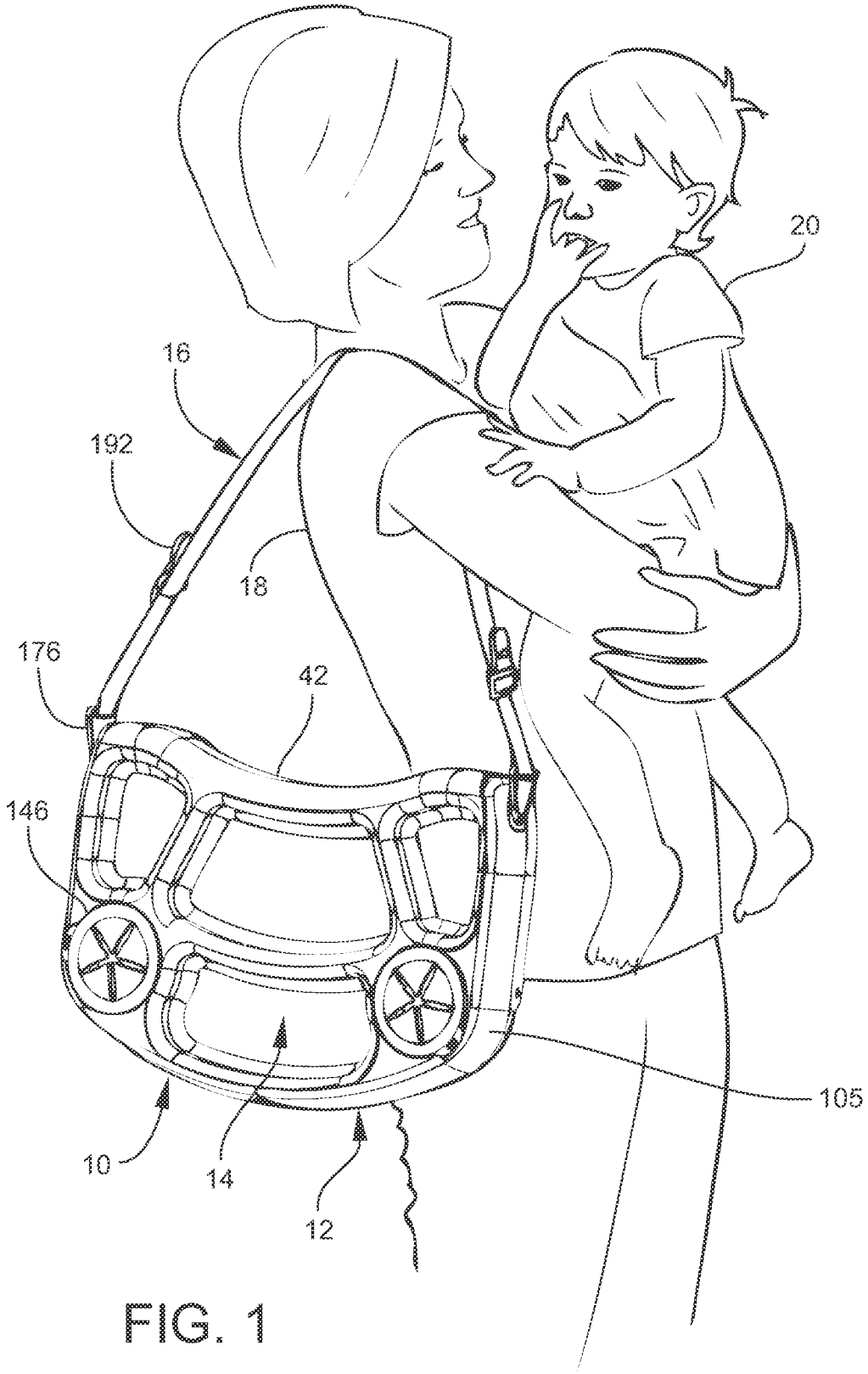
FIG. 1 is a perspective view of the present dine and draw child lap tray apparatus engaged by a carrying strap that is hooked over the shoulder of a caregiver.

As shown in FIG. 1, the present dine and draw child tray apparatus is indicated in general by the reference numeral 10. Tray apparatus 10 includes a base or activity tray 12, a food tray 14, and a strap apparatus 16. Food tray 14 is nestled into and engaged to the base tray 12. Food tray 14 may be separated from the base tray 12. Tray apparatus 10 is sufficiently light to be portable. Strap apparatus 16 is being carried over a shoulder of a caretaker 18. Tray apparatus 10 is intended to be used by a child 20.

Figure 2:
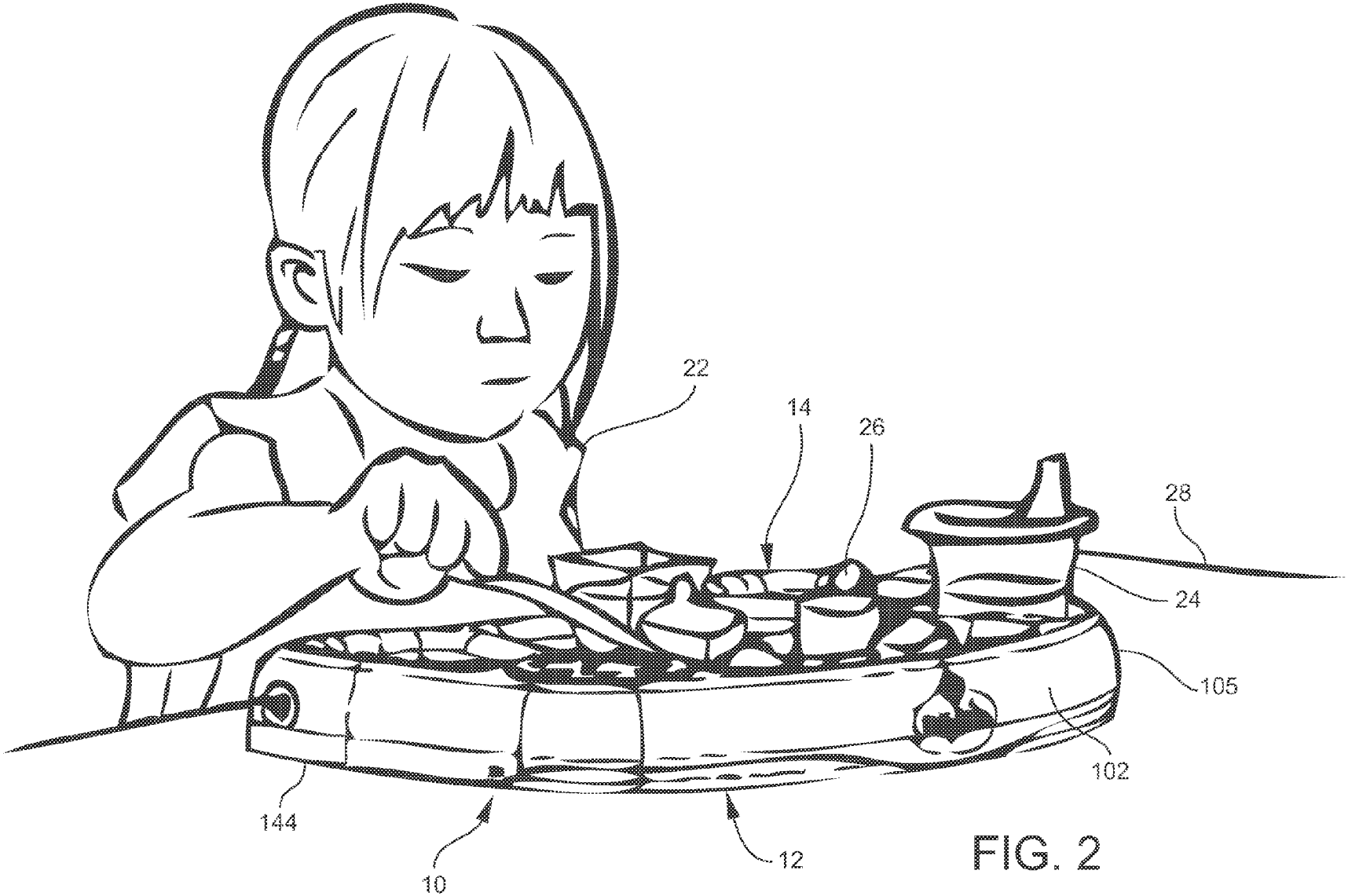
FIG. 2 is a perspective view of the dine and draw child tray lap apparatus of FIG. 1 being used in the dining mode where a food tray is engaged on top of the base or activity tray.

FIG. 2 shows the dine and draw child tray apparatus 10 being used for dining by a child 22. FIG. 2 further shows a cup 24 and a food article 26. The base tray 12 is resting on a table 28.

Figure 3:
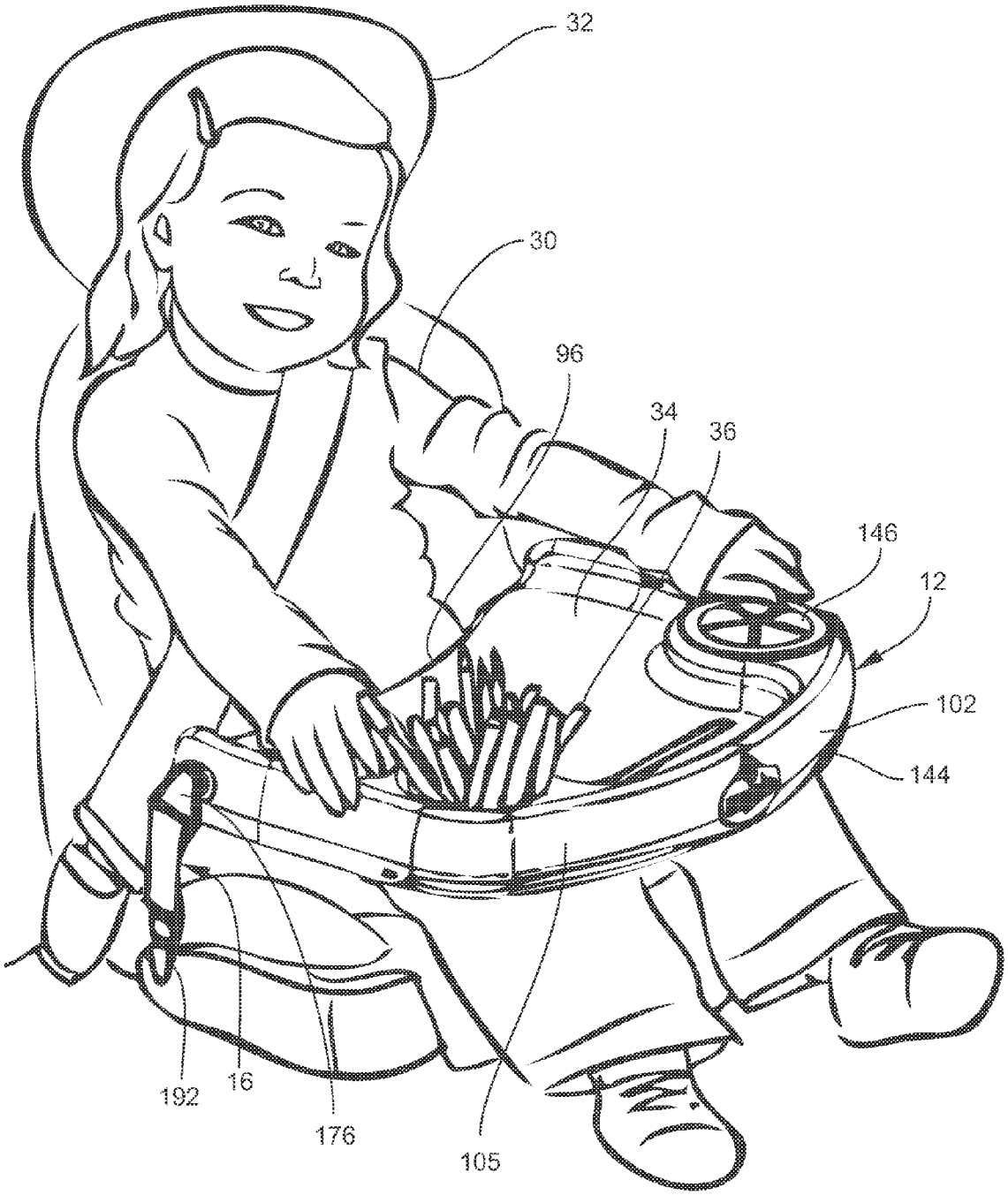
FIG. 3 is a perspective view of the dine and draw child lap tray apparatus of FIG. 1 being used in the drawing mode where the food tray has been removed and the base or activity tray is exposed for use.

FIG. 3 shows the base tray 12 being used for drawing by a child 30, where the food tray 14 has been removed from the base tray 12. The base tray 12 is resting on the legs or lap of the child 30. The child 30 is in a car seat 32. Each of the ends of the base tray 12 is anchored by a portion of the strap apparatus 16 to a part of the car seat 32. Base tray 12 includes a desk surface 34. Base tray 12 can hold a number of writing implements 36.

Figure 4:
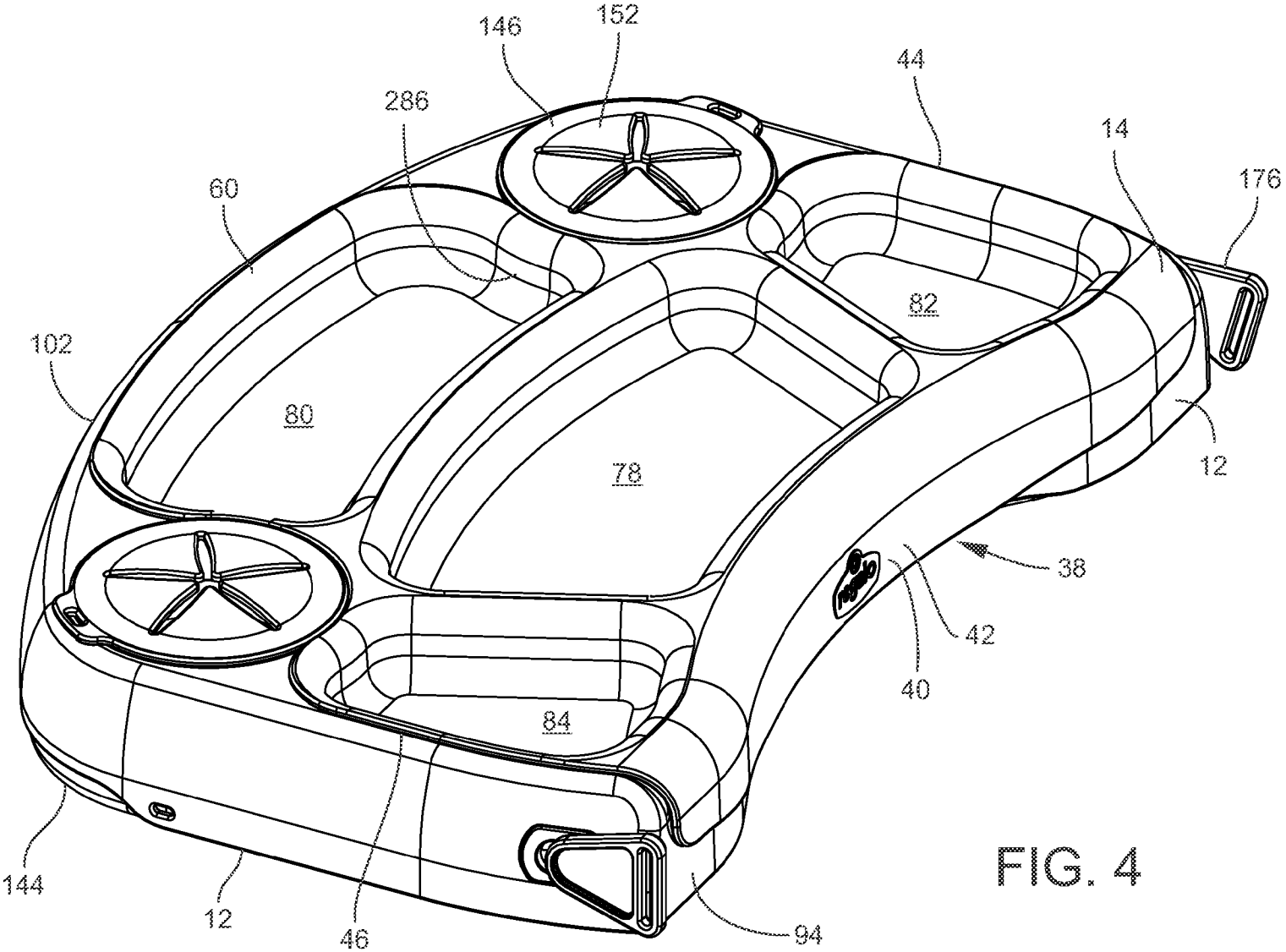
FIG. 4 is a perspective top view of the dine and draw child lap tray apparatus of FIG. 1 without the carrying strap, where the dine and draw child tray apparatus is shown in the dining mode where the food tray is on top of the base tray.
Figure 5:
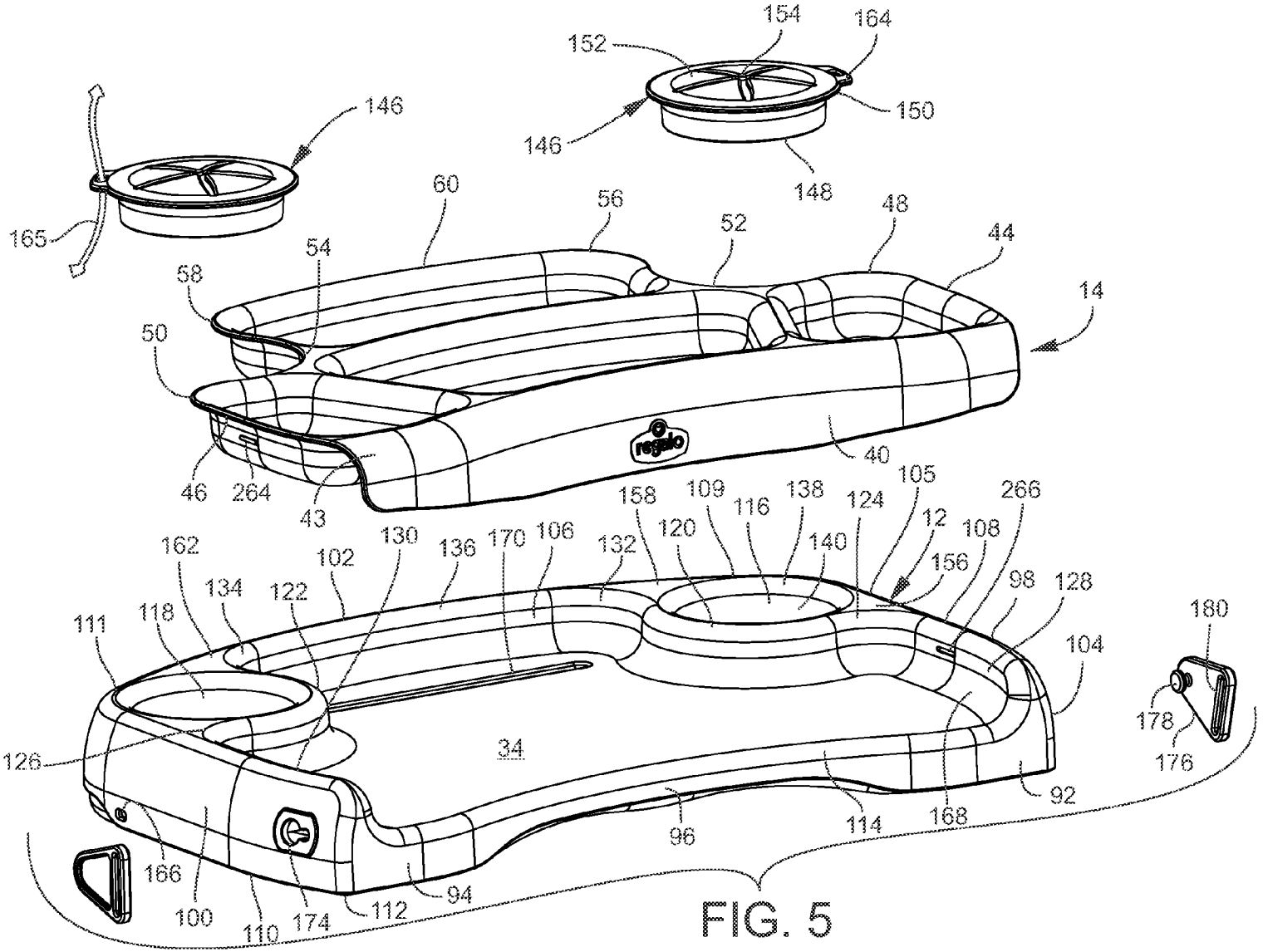
FIG. 5 is an exploded perspective view of the dine and draw child lap tray apparatus of FIG. 1, where the food tray is shown apart from the base tray.
Figure 6:
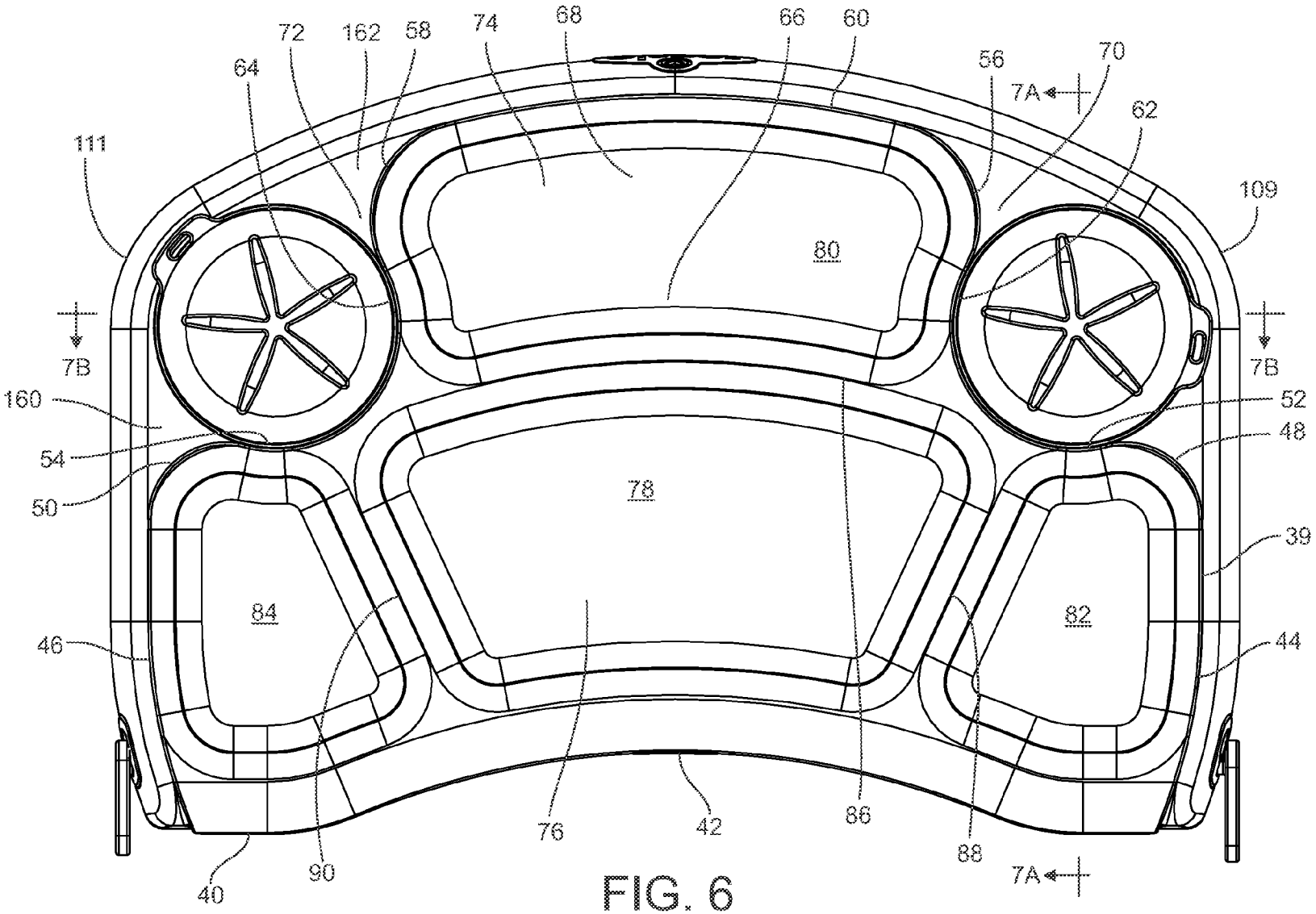
FIG. 6 is a top view of the dine and draw child lap tray apparatus in the dining mode where the food tray is on top of the base tray.

FIGS. 4, 5 and 6 show the food tray 14. FIG. 4 shows the food tray 14 nestled into the base tray 12. Food tray 14 is one-piece and integral. Food tray 14 is a molded plastic piece.

Food tray 14 includes a periphery 38. Periphery 38 includes a proximal wall 40. Proximal wall 40 extends in the horizontal direction from one end of the food tray 14 to the other end of the food tray 14 and, when the food tray 14 is on the base tray 12, proximal wall 40 extends from one end of the base tray 12 to the other end of the base tray 12. Proximal wall 40 includes a concave or arcuate or inwardly extending wall section 42 intermediate the ends of the proximal wall 40. Concave wall section 42 extends inwardly toward a distal portion of the food tray 14 and may receive a stomach or portion of a torso of a child. The concave wall section 42 and accompanying portion of the base tray 12 tailor the tray apparatus 10 to the torso of a child and permits the tray apparatus 10 to be drawn more closely to the torso of a child.

Figure 8:
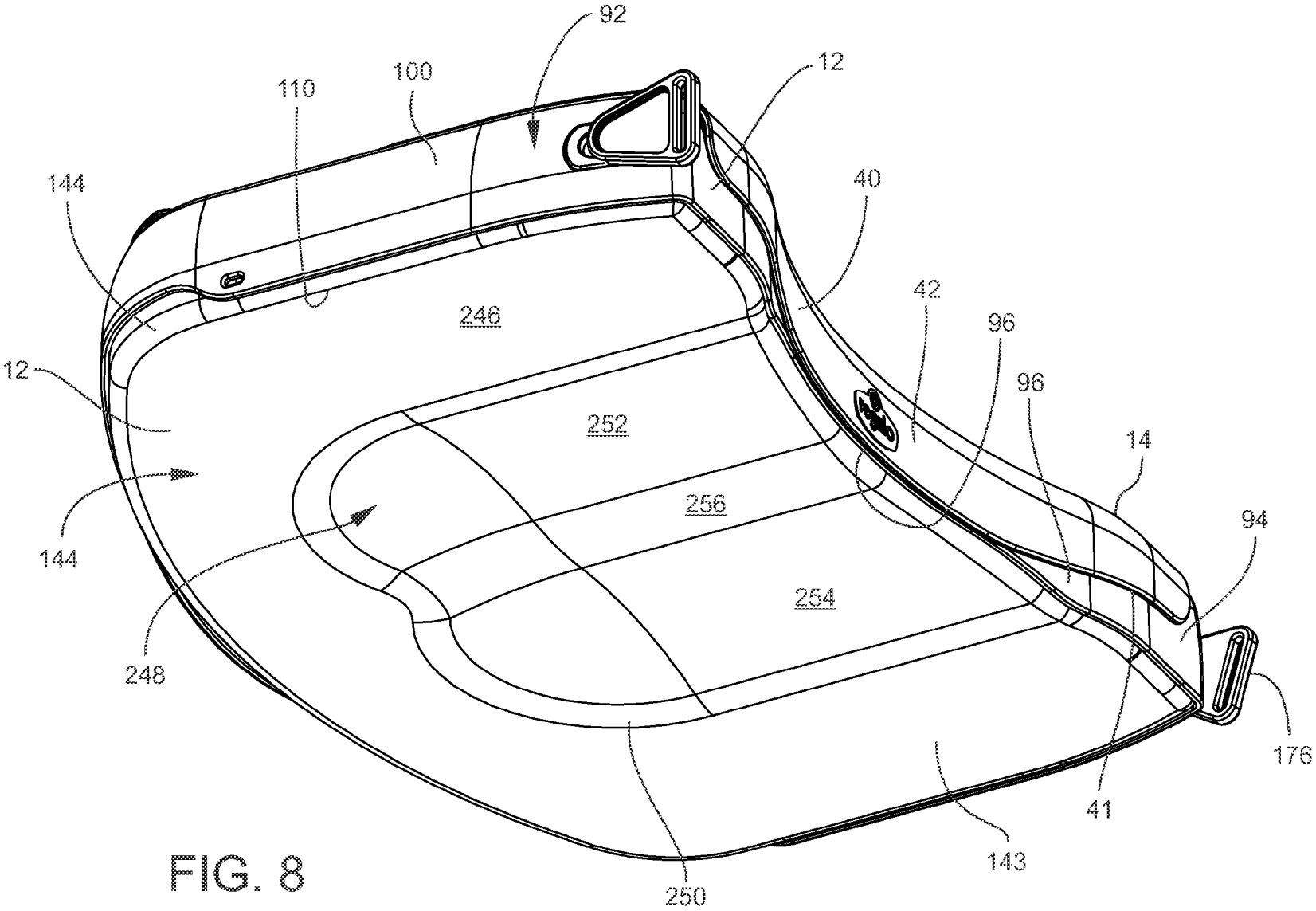
FIG. 8 is a perspective bottom view of the dine and draw child tray apparatus of FIG. 1.
Figures 9A, 9B, 9C:
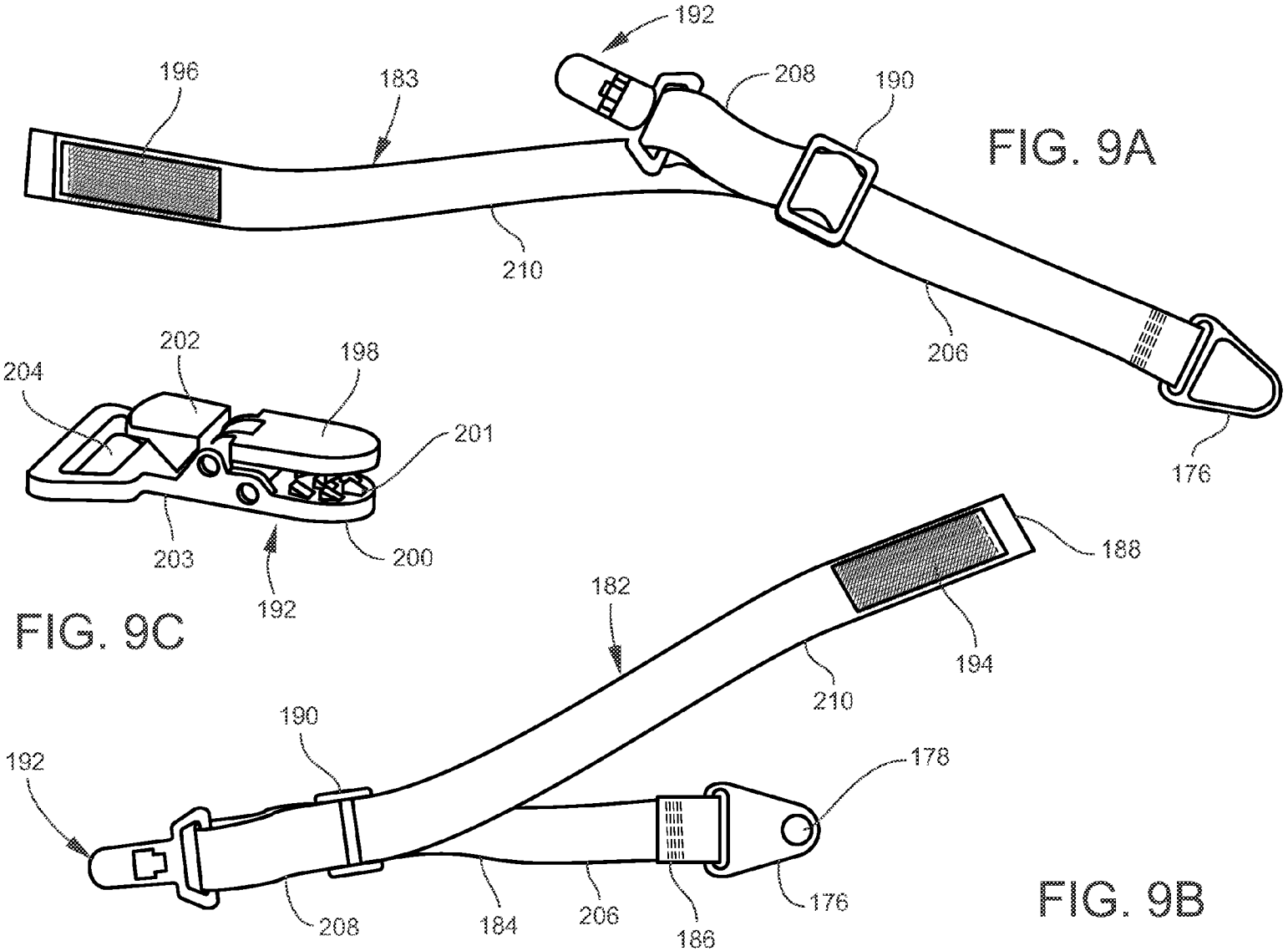
FIG. 9A is a perspective view of the upper side of one of the strap units shown in FIG. 1, where the strap of FIG. 1 is made up of two strap units, with each of the strap units being identical to the other strap unit with the exception that one of the hook and loop fabric fasteners includes loops and is on one side of the strap and the other of the hook and loop fabric fasteners includes hooks and is on the other side of the strap relative to headed pin.
FIG. 9B is a perspective view of the lower side of the strap unit of FIG. 9A to, for example, illustrate that hook and loop quick connectors are disposed opposite of each other at an end of the strap unit.
FIG. 9C is a perspective view of a clip of the strap unit of FIGS. 9A and 9B in a closed position.

In a generally vertical direction, proximal wall 40 extends from a top of the base tray 12 towards a bottom of the base tray 12. As shown in FIG. 8, front end portions of the proximal wall 40 extend downwardly to approximately a middle of the base tray 12 where a middle of the base tray 12 is defined as a plane cutting horizontally through the base tray 12 half-way between a top and bottom of the base tray 12. A central portion of the proximal wall 40 extends downwardly to the bottom of the base tray 12. A lower edge 41 of the proximal wall 40 tapers from an end of the proximal wall 40 to the central portion of the proximal wall 40. Lower edge 41 at the central portion of the proximal wall 40 is generally flush or resides at a slightly greater height than the lower central edge of the concave section 96 of base tray 12 such that the bottom side 144 and the resilient material of the bottom side 144 extends to a greater depth than the hard plastic material of the base tray 12 and to a greater depth than the food tray 14 or 258. The lower edge of proximal wall 94 of base tray 12 tapers upwardly from opposing ends toward a central region of the proximal wall 94 while the lower edge of proximal wall 40 of food tray 14 tapers downwardly from opposing ends toward a central region of the proximal wall 40 of food tray 14. Each of the proximal wall 94 and U-shaped outer wall 105 of base tray 12 includes a lower edge and the resilient material of bottom 144 extends downwardly beyond or below these lower edges such that the resilient material makes contact with the lap of a child instead of the hard plastic material of the proximal wall 94 and U-shaped outer wall 105.

Each of base tray 12 and food tray 14 includes a depth, and the depth of the proximal wall 40 at the end portions of the proximal wall is about one-half of the depth of the base tray 12. The depth of the proximal wall 40 at the central portion of the proximal wall 40 is about the depth of the base tray 12. When food tray 14 is on and nestled into base tray 12, proximal wall 40 from end to end and including the central portion extends vertically below a depth of the desk surface 34 so as to close off the desk surface 34.

Proximal wall 40 includes a rounded top 43 running laterally from end to end of the proximal wall 40. Each of the ends of the rounded top 43 of the proximal wall 40 nests onto or is seated on like shaped ends of the base tray 12. The rounded top 43 forms a transition between the proximal wall 40 and food compartments of the food tray 14. From the food compartments, the rounded top 43 curls longitudinally to and through a peak and then proceeds downwardly to the bottom edge of the proximal wall 40, which bottom edge includes tapered edge portion 41.

The periphery 38 of the food tray 14 further includes an undulating lip 39 running about the food tray 14 from one end of the proximal wall 40 to the other end of the proximal wall 40. Lip 39 is seated by the undulating inner wall 106 having the same undulations.

This peripheral lip 39 includes a right side lip section 44 at a right end of the tray apparatus 14, with the right end being defined as adjacent to the right arm of a child using the tray apparatus 10. Right side lip section 44 extends distally from the proximal wall 40.

The right side lip section 44 is the upper part of an S-shaped wall structure that extends from the floor of food compartment 82, to a right side wall of food compartment 82, to curl laterally to the lip section 44.

A left side lip section 46 opposes right side lip section 44. Left side lip section 46 extends distally from the other end of proximal wall 40. Lip section 46 is the upper part of an S-shaped wall structure that extends from the floor of food compartment 84, to a left side wall of food compartment 84, to curl laterally to the lip section 46.

Lip sections 44, 46 run distally and respectively into right and left rounded or curved corner lip sections 48, 50 that turn inwardly from the lip sections 44, 46. Lip sections 48, 50 form the upper parts of S-shaped wall structures that extend from the floors of their respective food compartments 82, 84.

Rounded corner lip sections 48, 50 then lead into right and left circular or curved lip sections 52, 54. Lip sections 52, 54 confront receptacles 116, 118 when the food tray 14 is on the base tray 12. A portion of each of the lip sections 48, 50 form the upper parts of S-shaped structures that extend from the floors of their respective food compartments 82, 84. A portion of each of lip sections 48, 50 form the upper parts of S-shaped wall structures that extend from the floor and right and left wall of distal food compartment 80.

Circular lip sections 52, 54 lead respectively into right and left rounded or curved corner lip sections 56, 58. The lip sections 52, 54 form the upper parts of S-shaped wall structures that extend from the floor of distal food compartment 80.

Corner lip sections 56, 58 lead into a distal convex or arcuate lip section 60 that opposes proximal concave wall section 42. Distal lip section 60 forms the upper part of an S-shaped wall structure that extends from the floor of distal food compartment 80. Convex lip section 60 and concave wall section 42 each thrust distally.

Each of the circular lip sections or wall structures 52, 54 has a respective right and left innermost point or location 62, 64. Locations 62, 64 define a neck 66 of the food tray 14. The portion of the food tray 14 distal of the neck 66 defines a head 68 of the food tray 14. The head 68 has a greater width than the neck 66. For example, the junction between circular lip section or wall structure 52 and corner lip section or wall structure 56 defines a location 70, and the junction between circular lip section or wall structure 54 and corner lip section or wall structure 58 defines a location 72. A straight line distance or width between these locations 70, 72 is greater than a straight line distance or width between locations 62, 64. Neck 66 and head 68 together define an insert portion 74. Insert portion 74 is generally formed in the shape of a dovetail. It should be noted that the portion 76 of the food tray 14 proximal of the neck 66 may also define a head that may be referred to as a proximal head 76 because this proximal portion 76 also has a greater width than the neck 66. The provision of neck 66, distal head 68, insert portion 74, and proximal head 76 prevent sliding in the horizontal direction of the food tray 14 relative to the base tray 12 because the periphery 39 of the food tray 14 nests into the complementary structure of the inner wall 106 of the base tray 12.

Food tray 14 includes four food compartments 78, 80, 82, 84. Food compartments 78, 82, 84 are proximal food compartments that are disposed adjacent to, and lead into, proximal wall 40. Food compartment 80 is the sole distal food compartment and leads into distal lip section 60.

Each of the compartments 78, 80, 82, 84 has a floor and four sidewalls such that each of the compartments 78, 80, 82, 84 is receptacle shaped. The floors of each of the proximal compartments 78, 82, 84 are generally trapezoidal. The overall general shape of each of the endless sidewalls of the proximal compartments 78, 82, 84 is generally trapezoidal, where an endless sidewall is defined as having four wall portions.

The floor of the distal compartment 80 is generally rectangular or slightly trapezoidal. The endless sidewall of distal compartment 80 forms generally a rectangle or slightly trapezoidal shape.

Distal compartment 80 is adjacent to lip section 60. Lip section 60 is the top part of the S-shaped structure that forms the distal wall of food compartment 80. Distal compartment 80 is adjacent to and distal of food compartment 78.

Proximal food compartment 78 is adjacent to distal food compartment 80 and proximal wall 40. Proximal food compartment 78 is between distal food compartment 80 and proximal wall 40.

Right proximal food compartment 82 is adjacent to right lip section 44. Lip section 44 forms the upper part of an S-shaped structure that forms the right wall of food compartment 82. Right proximal food compartment 82 is adjacent to proximal wall 40 and proximal food compartment 78.

Left proximal food compartment 84 is adjacent to left lip section 46. Lip section 46 forms the upper part of an S-shaped structure that forms the left wall of food compartment 84. Left proximal food compartment 84 is adjacent to proximal wall 40 and proximal food compartment 78.

Wall 86 separates proximal food compartment 78 from distal food compartment 80. Wall 88 separates proximal food compartment 78 from right food compartment 82. Wall 90 separates proximal food compartment 78 from left food compartment 84.

In terms of volume, where the volume of each of the food compartments 78, 80, 82, 84 is defined by the space in each of the compartments where each of the compartments is covered by an imaginary horizontal plane resting on top of walls 86, 88 and 90, food compartment 78 has the greatest volume, food compartment 80 has the second most volume, and each of food compartments 82 and 84 has the third most volume.

Food tray 14 generally includes three projections extending horizontally. A first projection is formed by distal food compartment 80. A second projection is formed by right side food compartment 82. A third projection is formed by left side food compartment 84.

Food tray 14 is formed of plastic and is dishwasher safe. Food tray 14 is integral and one-piece.

As shown in FIG. 5, base tray 12 includes a perimeter 92. Perimeter 92 includes an outer wall 104. The outer wall 104 includes a proximal wall section 94 and a U-shaped wall 105. The undulating inner wall 106 is disposed inwardly of the U-shaped wall 105. Receptacles 116, 118 are disposed between the inner wall 106 and the outer wall 105. Outer wall 104 includes a desk opening 113. Outer wall 104 includes a foreshortened height at the desk opening 113 and a full height at the U-shaped wall 105.

The proximal wall section 94 of the outer wall 104 extends parallel to the proximal wall 40 of the food tray 14. Proximal wall section 94 includes an inwardly extending or concave or arcuate wall portion 96 that extends parallel to the concave or arcuate wall section 42 of the food tray 14.

Outer wall 104, minus proximal wall section 94, is U-shaped. This U-shaped full height wall 105 runs the entire depth of base tray 12, minus the resilient material of bottom side 144, so as to include an upper edge 108 and a lower edge 110. The resilient material of bottom side 144 extends below or beyond lower edge 110 as well as below or beyond the lower edge of proximal wall section 94. Upper edge 108 includes a radius or inward curvature. U-shaped wall 105 and proximal wall section 94 form a radius or junction 112.

U-shaped wall 105 includes a right side outer wall section 98 leading distally away from proximal outer wall section 94 and a left side outer wall section 100 leading distally away from proximal outer wall section 94. Right side and left side outer wall sections 98, 100 then lead into distal outer wall section 102. Right side and left side outer wall sections 98, 100 are generally straight and distal outer wall section 102 is convex. A rounded or curved corner outer wall section 109 is disposed between outer wall section 98 and outer wall section 102. A rounded or curved corner outer wall section 111 is disposed between outer wall section 100 and outer wall section 102. A proximal end of outer wall section 98 extends obliquely inwardly to right end junction 112. A proximal end of outer wall section 100 extends obliquely inwardly to left end junction 112.

Desk opening 113 extends generally between end junctions 112 and above junction 114. Desk opening 113 may be defined as an open space where the U-shaped wall 105 would otherwise extend along the proximal edge portion 94 or wall 94. Desk opening 113 extends above junction 114.

Inner wall 106 forms a portion of the boundary of the desk surface 34. The other portion of the boundary of the desk surface 34 is formed by proximal wall section 94 or, more specifically, a junction 114 between the desk surface 34 and the proximal wall section 94. The junction 114 has a depth equal to or greater than a depth of the desk surface 34 relative to upper edge 108 of U-shaped wall 105 such that the junction 114 runs downwardly and outwardly and does not hinder the forearms or hands of a child from having access to the desk surface 34 or from writing or drawing on the desk surface 34.

Undulating inner wall 106 runs adjacent to U-shaped outer wall 105 except where inner wall 106 runs about receptacles 116, 118. From proximal wall section 94, inner wall 106 runs adjacent to and parallel to right and left outer wall sections 98, 100 for a portion of sections 98, 100. Then inner wall 106 runs inwardly away from right and left outer wall sections 98, 100 and runs about receptacles 116, 118. Then inner wall 106 runs adjacent to U-shaped outer wall 105 again for a length of the distal wall section 102.

Inner wall 106 includes a circular inner wall section 120 disposed between receptacle 116 and desk surface 34. An identical circular inner wall section 122 is disposed between receptacle 118 and desk surface 34. The circular inner wall sections 120, 122 seat the circular or curved lip sections 52, 54 of the food tray 14.

Inner wall 106 further includes proximal transition or corner inner wall sections 124, 126 that seat corner lip sections 48, 50 of the food tray 14. Corner inner wall sections 124, 126 of inner wall 106 lead into generally straight inner wall sections 128, 130 that seat right and left side lip sections 44, 46 of food tray 14.

Inner wall 106 further includes transitional or corner inner wall sections 132, 134 that run distally from circular inner wall sections 120, 122 and run into a distal inner wall section 136. Transitional inner wall sections 132, 134 seat corner lip sections 56, 58 of the food tray 14. Distal inner wall section 136 seats distal lip section 60 of food tray 14.

When the food tray 14 is in the base tray 12, the mass or weight of the food tray 14 is borne by one or more of 1) the desk surface 34, 2) the seating of the food tray lip or periphery 39 on the undulating inner wall 106, and 3) the S-shaped structures formed in part by the floor of the food compartments 80, 82 and 84, walls of these food compartment, and lip sections of the lip or periphery 39. The bottom surfaces of the food compartments 78, 80, 82, 84 make contact with the desk surface 34. The S-shaped structures of the food tray 14 make contact with identical S-shaped surfaces formed by the inner wall 106 in combination with desk surface 34. The lip or periphery 39 makes contact with the upper edge of inner wall 106.

Figure 7A:
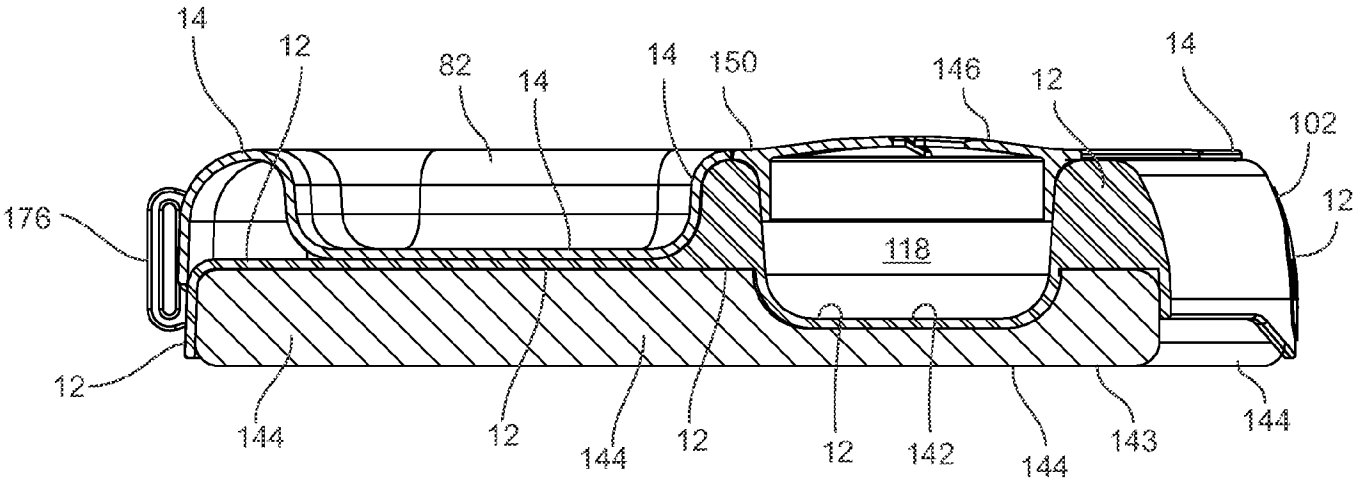
FIG. 7A is a section view at lines 7A-7A of FIG. 6.
Figure 7B:
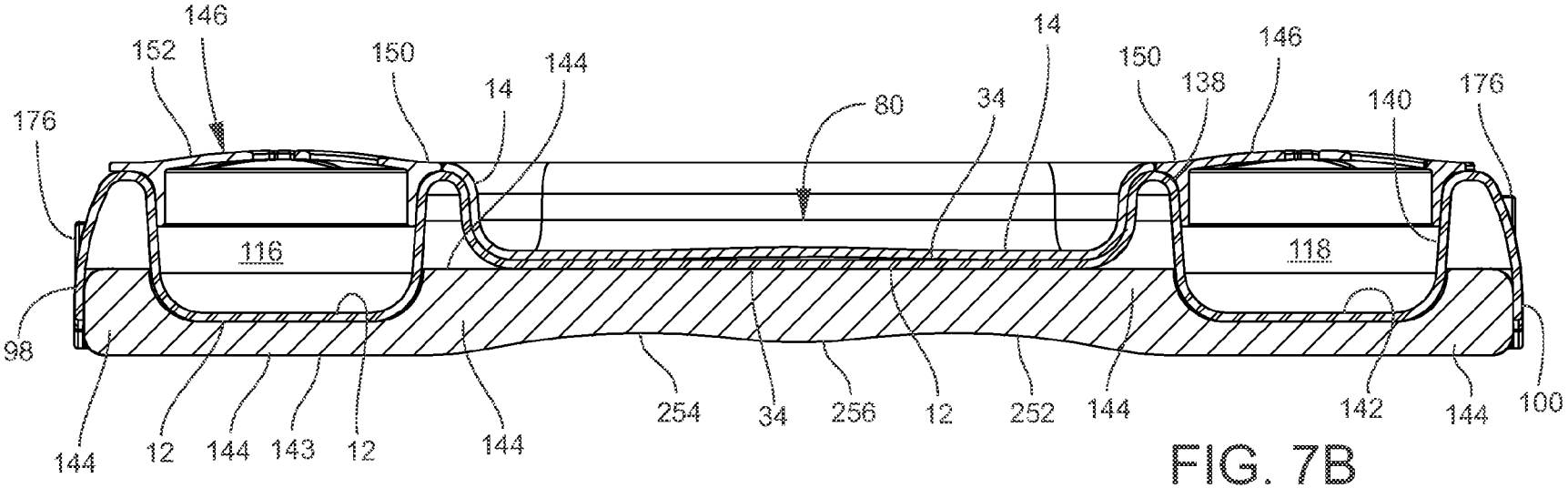
FIG. 7B is a section view at lines 7B-7B of FIG. 6.

Each of the receptacles 116, 118 includes a tapered upper and inner annular edge 138. Edge 138 is endless and tapers inwardly and downwardly. Edge 138 acts as a guide for a glass or cup or other drinking receptacle or a writing utensil such as a pen or pencil or other type of article or object. As shown in FIGS. 7A and 7B, edge 138 leads into a tapered endless sidewall 140 that leads into a floor 142. Tapered endless sidewall 140 takes generally a cylindrical shape. Endless sidewall 140 may take a frustoconical shape if desired.

The depth of floor 142 defines the depth of each of the receptacles 116, 118 relative to the upper edge 108 of U-shaped wall 105. The depth of floor 142 is greater than the depth of the desk surface 34. The depth of floor 142 is maximized so as to maximize the stability of a glass or cup or other drinking container in the receptacles 116, 118. The depth of floor 142 is maximized by disposing the floor 142 relatively closely to a bottom surface 143 of a bottom 144 of the base tray 12.

Each of the receptacles 116, 118 may be closed by a lid 146. Lid 146 includes a cylindrical annular insert portion 148. If receptacle sidewall 140 is frustoconical, annular insert portion 148 can be frustoconical. Annular insert portion 148 extends downwardly generally vertically so as to depend from a horizontally extending annular lip 150. Lip 150 extends outwardly relative to insert portion 148. Integrally extending inwardly from lip 150 are five triangular petals 152. One side of petal 152 is integral with lip 150. The other two sides of petal 152 are straight and adjacent to and spaced from a straight side of another petal 152. The free tip of petal 152 is adjacent to each of the other free tips of the other petals 152. Each of the petals 152 rises slightly from the inner edge of lip 150 to a center top portion 154 of lid 146 where the free tips of petals 152 are adjacent to each other. This rise in elevation of petals 152 can be seen in the section views of 7A and 7B. The adjacent and spaced apart petals 152 permits pens and pencils, other writing utensils and other articles and objects to be received in the receptacles 116 and 118 and held therein because the radially extending edges of the sides of the petals 152, as well as the upper and lower faces of the petals 152, act as frictional grippers. The resilient petals 152 flex and twist as articles are placed therein, then resiliently attempt to flex back after being flexed to an altered state by an article, and then when the article is removed resiliently flex back to the rest state shown in FIGS. 5, 7A and 7B.

When engaged on receptacle 116, lip 150 of lid 146 engages outer circular wall portion 109, inner circular wall portion 120, a flat surface 156 and a flat surface 158. Flat surface 156 is bounded by receptacle 116, wall 108, and corner wall portion 124 such that flat surface 156 has two curved sides and a straight side. Flat surface 158 is bounded by receptacle 116, distal wall 102 and inner corner wall portion 132 such that flat surface 158 has three curved sides.

When engaged on receptacle 118, lip 150 of lid 146 engages outer circular wall portion 111, inner circular wall portion 122, a flat surface 160 and a flat surface 162. Flat surface 160 is bounded by receptacle 118, wall 110, and corner wall portion 126 such that flat surface 160 has two curved sides and a straight side. Flat surface 162 is bounded by receptacle 118, distal wall 102 and inner corner wall portion 134 such that flat surface 162 has three curved sides.

As shown in FIGS. 7A and 7B, when lid 146 and food tray 14 are on the base tray 12 at the same time, lip 150 runs adjacent to and abuts the food tray 14 such as at the inner most points 62, 64, such as at the sidewalls that define food compartment 80, and such as at the sidewalls that define food compartments 82, 84.

Lid 146 includes an integral apertured tab 164 extending from lip 150 in the plane of the lip 150 such that tab 164 extends horizontally. Tab 164 includes an aperture for a plastic flexible element such as a tether or cord 165, shown in phantom in FIG. 5. One end of the plastic flexible element is engaged to the aperture tab 164. Another end of the plastic flexible element can be snapped into an opening 166 formed in opening 110. When connected between the tab 164 and opening 166, the plastic flexible element minimizes loss of lid 146.

Lid 146 frictionally fits into its respective receptacle 116, 118 with a gripping force that is greater than the gripping force that petals 152 apply to articles such as pens and pencils such that, when an article such as a pen or pencil is withdrawn from one of the receptacles 116, 118, only the pen or pencil is withdrawn, not the lid 146 from its respective receptacle 116, 118.

Lid 146 may also be described as a pressure fit lid. In other words, the annular insert portion 148 may resiliently be forced to flex to a smaller annulus when the insert portion 148 is pushed into one of the receptacles 116, 118. The insert portion 148 when flexed pushes back against the sidewall of the receptacles 116, 118 to provide a gripping force that keeps the lid 146 secure in the respective receptacle 116, 118.

Lid 146 may be formed of a clear, transparent, translucent, or opaque plastic material.

Lid 146 may keep cereal in receptacle 116, 118 until a child's hand reaches in for a snack. Petals 152 flex as a hand reaches in. Even if the base tray 12 is overturned, the petals 152 of lid 146 keep the small cereal pieces in the respective receptacle 116, 118.

The inner wall 106 of the base tray 12 that partially defines the desk surface 34 is an undulating wall. The outer wall 105 of the base tray 12 is a U-shaped wall. The space between walls 105, 106 may be hollow or empty space or may be filled entirely or partially with the material of bottom side 144.

The inner wall 106 transitions through a radius or curved portion 168 into the flat desk surface 34 such that the desk surface 34 does not abruptly terminate at a right angle junction. This curved portion 168 permits easy cleaning of the desk surface. Food particles, for example, are likely to stick in a right angled junction and are unlikely to stick in curved portion 168. This curved portion 168 is part of the S-shaped structure that is formed in part by inner wall 106 and in part by desk surface 34.

Base tray 12 includes a groove 170 in the desk surface 34. Groove 170 is disposed between receptacles 116 and 118. Groove 170 includes one end spaced from receptacle 116 and the other end spaced from receptacle 118. Groove 170 is adjacent to and spaced from distal wall 102. Groove 170 is straight from end to end. Other than groove 170, desk surface 34 is smooth and flat. Groove 170 is a receptacle for a writing utensil such as a pen or pencil.

As indicated, inner wall 106 of base tray 12 is an undulating inner wall and outer wall 105 of base tray 12 is generally a U-shaped outer wall. The undulating feature or undulation of the inner wall 106 in combination with the U-shaped outer wall provides space for the placement of receptacles 116, 118.

Base tray 12 further includes a pair of keyhole shaped openings or connections 174. One of the keyhole openings 174 is formed in wall 98 and the other of the keyhole openings 174 is formed in wall 110. The keyhole openings 174 are proximally located so as to be adjacent to proximal wall section 94. The smaller hole of the keyhole opening 174 is closer to the proximal wall section 94 than the larger hole of the keyhole opening 174 since the tray apparatus 10 is usually carried on a shoulder, as shown in FIG. 1. Keyhole opening 174 engages base connector 176. Strap connector 176 includes a headed pin 178. The head of the pin 178 slides into the larger opening of the keyhole opening 174, and then the shaft of the pin 178 slides and snaps into the smaller opening of keyhole opening 174 such that the head of the pin 178 is locked against the back of the portion of the wall forming the smaller opening of the keyhole opening 174. The snapping is provided by forming the diameter of the shaft of the headed pin 178 slightly greater than the width of the transition from the larger hole to the smaller hole of the keyhole opening 174. Base connector 176 can be a molded plastic or metal piece. Base connector 176 includes a slot 180 for receiving a strap portion of strap apparatus 16.

Strap apparatus 16 is shown in FIG. 1 and FIGS. 9A, 9B and 9C. Strap apparatus 16 includes two strap units 182, 183. The strap units 182, 183 are identical except for the placement and type of hook and loop fasteners. One strap unit 182 is engaged to one of the keyhole openings 174. The other strap unit 183 is engaged to the other of the keyhole opening 174.

Strap unit 182 includes a strap 184 that includes a first end 186 and a second end 188. First end 186 extends through slot 180 and is then doubled back and stitched to strap 184 to engage the base connector 176 to the strap 184. Strap 184 then extends to a slide buckle 190, which may also be referred to as a buckle or buckle slide, and continues on to an alligator clip 192. The strap 184 then extends back to and through slide buckle 190 and continues on to the second end 188 where loop fabric fastener material 194 is stitched to the second end 188. Loop fabric fastener material 194 is stitched to the side of the strap unit 182 from which headed pin 178 extends. On strap unit 182, a hook fabric fastener material 196 is stitched to the side of the strap unit 183 opposite of the side from which headed pin 178 extends such that the loop material 194 and hook material 196 are brought together face to face without any twists in the strap 184. The material selected for use of the hook and loop fastener fabric material may be that material known as Velcro®.

Alligator clip 192 includes a pair of jaws 198, 200. Each of the interior faces of the jaws 198, 200 has a roughened surface with teeth 201. Teeth 201 of the respective jaws 198, 200 oppose each other. The jaws 198, 200 are opened relative to each other by lifting up lever 202 relative to a base 203 or drawing away lever 202 from base 203, an action that draws jaw 198 away from jaw 200. Strap 184 extends through slot 204 formed in base 203. Base 203 and jaw 200 are coplanar, formed from the same piece of plastic, and are one-piece and integral with each other.

Alligator clip 192 is used to hold down an end of the tray apparatus 10. For example, if a child using the tray apparatus 10 is in a car seat, the jaws 198, 200 of one strap unit 182 may be clipped to a portion of the car seat and the jaws 198, 200 of the other strap unit 183 may be clipped to another portion of the car seat.

The action of alligator clip 192 is shown in FIGS. 10A, 10B, 10C and 10D. Clip 192 is referred to as an alligator clip because of the provision of teeth 201 on each of the jaws 198, 200 and because of the provision of relatively elongate jaws 198, 200.

Each of the strap units 182, 183 includes one continuous piece of strap material, strap 184. This strap 184 includes three strap portions 206, 208, 210. Strap portion 208 includes two strips or sections of strap 184 facing each other.

When alligator clip 192 is used, strap portions 206 and 208 hold the base tray 12 tight to the articles or objects to which the clips 192 are engaged and strap portion 210 may not be used and may be tucked out of the way.

When the hook and loop fabric fasteners 194 and 196 are connected to each other so as to form a U-shaped carrying strap such as shown in FIG. 1, strap portions 206, 210 are used and strap portion 208 may not be used and may be tucked out of the way.

Slide buckle 190 provides a tortuous path for two layers of the strap 184 and effectively provides an impingement between the two layers 184 until one of the layers 184 is manually drawn back or slid back a tad through the slide buckle 190, whereupon the slide buckle 190 can be slid to a new position. For example, the slide buckle 190 can be slid in a direction toward base connector 176. Or the slide buckle 190 can be slid in a direction toward alligator clip 192.

Alligator clip 192 is preferably not stitched to one location on strap 184. Slide buckle 190 can be slid to be adjacent to the alligator clip 192 if desired.

A shoulder strap is formed from strap apparatus 16 by sliding the slide buckle 190 to form the desired length of one strap unit 182, then sliding the other slide buckle 190 on the other strap unit 183 to form the desired length of strap unit 183, connecting the base connectors 176 to their respective keyhole openings 174, then bringing loop fastener fabric 194 of strap unit 182 into contact with loop fastener fabric 196 of strap unit 183 to form a full length shoulder strap 16 as shown in FIG. 1.

Figure 12A:
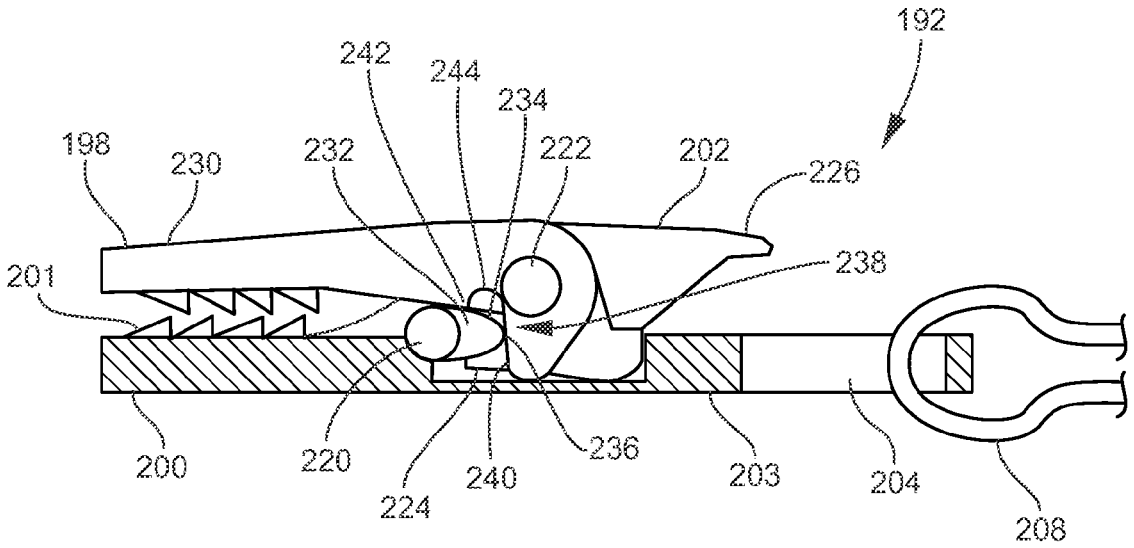
FIG. 12A is a detail view of the clip of FIG. 9C in a closed, locking position.
Figure 12B:
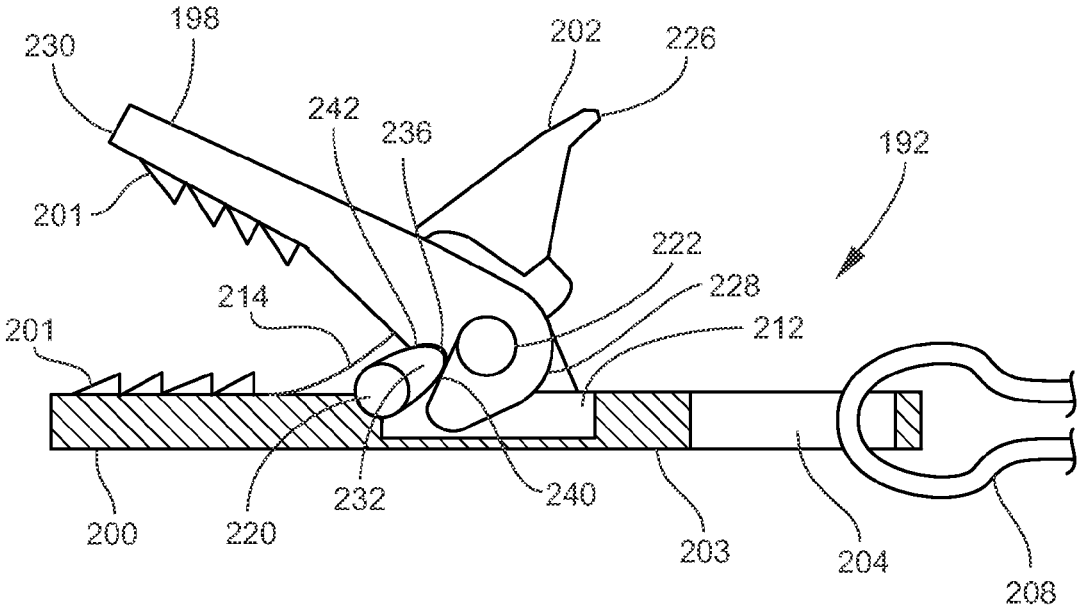
FIG. 12B is a detail view of the clip of FIG. 12A in an open position.

The alligator clip 192 is shown in greater detail in FIGS. 12A and 12B. Base 203 includes stationary jaw 200. Jaw 200 is a jaw at rest relative to base 203. Jaw 200 is one-piece and integral with base 203. Base 203 further includes the slot 204 for the strap portion 208. Base 203 further includes a recess 212 into which portions of the pivoting jaw 198 and lever 202 extend and may snap closed. Base 203 further includes a pair of opposing upwardly extending side plates 214. Side plates 214 extend at a right angle relative to base 203. Side plates 214 extend from and form a portion of a periphery of base 203. Each of the side plates 214 includes a pair of pivot holes or receivers 216, 218. Pivot hole 216 of one side plate 214 is aligned with the other pivot hole 216 of the other side plate 214. Pivot hole 218 of one side plate 214 is aligned with the other pivot hole 218 of the other side plate 214. Pivot hole 216 receives a pivot shaft 220 integral and one-piece with lever 202. Pivot hole 218 receives a pivot shaft 222 integral and one-piece with pivoting jaw 198.

Lever 202 includes a proximal end 224 that is adjacent to the pivot shaft 220. Lever 202 includes a distal end 226 that is distal of the pivot shaft 220.

Pivoting jaw 198 includes a proximal end 228 that is adjacent to the pivot shaft 222. Pivoting jaw 198 includes a distal end 230.

Proximal end 224 of lever 202 includes an extension 232 having an edge 234 and a rounded end 236. Extension 232, edge 234 and rounded end 236 are integral and one-piece with lever 202 and pivot when lever 202 is pivoted.

Proximal end 228 of pivoting jaw 198 includes a hook shaped structure 238 formed by an edge 240, a point 242 and a rounded receptor 244. Edge 240 extends laterally. Point 242 is an edge that extends laterally. Rounded receptor 244 extends laterally.

Clip 192 is operated by pulling up on distal end 226 of lever 202 such that the distal end 226 is drawn away from base 203. When distal end 226 is pulled up, pivot shaft 220 rotates. As pivot shaft 220 rotates, extension 232 rotates. As extension 232 rotates, edge 234 of lever 202 rotates against point 242 of pivoting jaw 198, thus urging jaw 198 to rotate about pivot shaft 222, thereby drawing distal end 230 of pivoting jaw 198 away from stationary jaw 200. Receiver 244 works as a stop to this rotation when extension 232 and rounded end 236 are received fully in receiver 244 since edge 234 no longer has a point 242 against which to work. Then, to close clip 192, distal end 226 of lever 202 is pushed downwardly or urged toward base 203, whereupon pivot shaft 220 is rotated, whereupon extension 232 is rotated, and whereupon rounded end 236 is rotated to slide against edge 240 of pivoting jaw 198. The action of rounded end 236 sliding against edge 240 rotates the proximal end 228 of the pivoting jaw 198 and swings distal end 230 of pivoting jaw 198 into engagement with stationary jaw 200.

An intermediate section of lever 202 can snap into recess 212 to lock clip 192 in the closed position shown in FIGS. 10C, 10D, and 12A. A sufficient amount of friction between pivot shafts 220, 222 and their respective pivot holes 216, 218 can hold the clip 192 in the open position as shown in FIGS. 10A, 10B and 12B, where distal end 230 of pivoting jaw 198 and distal end 226 of lever 202 have been swung away from base 203.

Clip 192 is springless. By the inclusion of a springless clip or clamp 192, the fingers and mouths of infants and children are spared from harm by an unintended closing, such as when a spring based clip slips from the fingers of a caregiver and snaps shut. Since clip 192 is springless, jaw 198 closes by the human hand. The most pressure that the jaws 198 and 200 can exert is limited by a stop, namely, when the intermediate section of the lever 202 makes contact with base 203 or the floor of the recess 212 of base 203.

In clip 192, pivot shafts 220, 222 run parallel to each other and extend from proximal ends of their respective bodies, where the respective bodies are the pivoting jaw 198 and the lever 202. If a straight line is drawn at a right angle from the axis of one pivoting shaft to the distal end of the body of such pivoting shaft and labeled A, and if a straight line is drawn at a right angle from the axis of the other pivoting shaft to the distal end of the other body of such pivoting shaft and labeled B, then A and B cross each other in the open position shown in FIG. 12B.

In clip 192, the pivoting shaft of one body is generally placed between the pivoting shaft and distal end of the other body. In other words, pivoting shaft 220 of lever 202 is generally disposed between distal end 230 and pivoting shaft 220 of pivoting jaw 198. Pivoting shaft 222 of the pivoting jaw 198 is disposed generally between pivoting shaft 220 and distal end 226 of lever 202.

In clip 192, a common planar base is employed, with the base being base 203. The distal ends of jaw 198 and lever 202 pivot or move to and away from base 203. The distal ends of jaws 198 and 200 move relatively to and away from each other. Distal end 226 of lever 202 pivots or moves relatively to and away from base 203.

In clip 192, when the jaws 198 and 200 pivot relatively away from each other, the distal ends 226 and 230 of the lever 202 and pivoting jaw 198 pivot relatively toward one another.

In clip 192, the proximal end 224 of lever 202 pushes the proximal end 228 of pivoting jaw 198 to rotate in one direction to open the jaw 198 and then pushes the proximal end 228 of jaw 198 in the other direction to close the jaw 198. When pushing in one direction, proximal end 224 employs edge 234. When pushing in the other direction proximal end 224 employs end 236.

In clip 192, lever 202 can be described as a cam and pivoting jaw 198 can be described as a follower. A cam can be a rotating or sliding piece in a mechanical linkage that transforms rotary motion into linear motion or vice versa. For example, extension 232 may be described as a tooth 232 protruding from pivot shaft 220 such that lever 202, pivot shaft 220 and tooth 232 as a whole is a cam or eccentric wheel and where pivoting jaw 198 is a follower, with the motion of the cam 202 being imparted to the follower 198 at point 242 in one direction of rotation and along edge 240 in the other direction of rotation.

As to clip 192, the following references are hereby incorporated by reference in their entireties: 1) the Noda U.S. Pat. No. 5,400,483 issued Mar. 28, 1995 and entitled Plastic Clip, 2) the Noda U.S. Pat. No. 5,778,497 issued Jul. 14, 1998 and entitled Plastic Clip, 3) the Noda U.S. Pat. No. 6,260,244 B1 issued Jul. 17, 2001 and entitled Plastic Clip, 4) the Lo U.S. Pat. No. 6,263,702 B1 issued Jul. 24, 2001 and entitled Structure Of An Ornamental Accessory, 5) the Takabayashi et al. U.S. Pat. No. 7,003,854 B2 issued Feb. 28, 2006 and entitled Cover And Decorative Cover For A Clip And Clip Set And A Nail Cover In Combination With A Plastic Clip, and 6) the Lo U.S. Pat. No. 8,156,616 B2 issued Apr. 17, 2012 and entitled Safe Pacifier Clip.

FIG. 8 shows the proximal wall 40 of the food tray 14 closing off the desk opening 113 of base tray 12. From the outer ends of the wall 40, the lower edge 41 of the wall 40 tapers toward a bottom surface 143 of the base tray 12. As the lower edge 41 tapers toward the bottom surface 143, the lower edge 41 and the wall 40 as a whole tapers inwardly or distally toward the distal edge portion 60 and toward the distal food compartment 80.

FIG. 8 further shows the bottom or bottom side 144 of the base tray 12. The bottom side 144 is formed of a material different from a remainder of the base tray 12. While this remainder of the base tray 12 is formed of a material that is noncompressible by the human hand, the bottom 144 is formed of a material that is resiliently compressible by the human hand. For example, the U-shaped wall 105, inner wall 106, desk surface 34, proximal wall 94, receptacles 116, 118 and other features make up a first portion of the base tray 12. This first portion or first part of the base tray 12 is formed of a hard plastic, such as polypropylene, that is noncompressible to the human hand. A second portion or second part of the base tray 12 is the bottom or bottom side 144 and this bottom or bottom side 144 is formed of a material that is resiliently compressible by the human hand. This second portion of the base tray 12 may include or consist of a resilient foam pad. The first and second portions of the base tray 12, or first and second parts of the base tray 12, or top and bottom sides of the base tray 12, are one-piece with each other and are not separable from each other without destroying an integrity of the base tray 12. These first and second parts of the base tray 12 are preferably glued with an adhesive or welded together or fastened together with rivets. However, if desired, these first and second parts may be removably fixed together with pin fasteners such as screws.

The bottom surface 143 of bottom side 144 includes a flat generally U-shaped surface portion 246. Surface portion 246 runs adjacent to the U-shaped wall 105. Surface portion 246 extends inwardly from the U-shaped wall 105 to run adjacent to a portion of the proximal wall 94. Surface portion 246 terminates generally where the concave wall section 96 begins to form in proximal wall 94. Inwardly of the U-shaped surface portion 246 is a lap receptor surface portion 248. A U-shaped tapering wall 250 forms a transition between the flat surface portion 246 and the lap receptor surface portion 248.

Bottom side 144 is formed of a material that is nonslip on flat table surfaces such as wood and on fabric clothing such as cotton. Such material may be selected from the group of materials including rubber materials, rubber like materials, elastomeric materials, polyurethane foam, open cell foam materials, and closed cell foam materials. The flat generally U-shaped surface portion 246 is the surface that the tray apparatus 10 rests on when the tray apparatus 10 is on a table. The flat surface portion 246 keeps the base 12 stable on a horizontal surface, and this flat surface portion 246 is also nonslip.

Lap receptor surface portion 248 includes a first thigh receptor 252, a second thigh receptor 254, and a raised wall 256 dividing the thigh receptors 252, 254. Lap receptor surface portion 248 extends from the concave wall section 42 distally toward the distal wall section 102 of the U-shaped wall 105.

U-shaped bottom flat surface portion 246 extends or protrudes beyond a lower edge 110 of the U-shaped wall 105. When base tray 12 is on a flat table or flat surface, flat surface portion 246 makes contact with the flat table or flat surface. Thigh receptors 252, 254 are recessed relative to the flat surface portion 246 such that thigh receptors 252, 254 and raised wall 256 are spaced from the flat table or flat surface when base tray 12 is on the flat table or flat surface. The further recessed receptors 252, 254 are, the greater depth such receptors 252, 254 have. Thigh receptors 252, 254 have a greater depth than raised wall 256. Raised wall 256 extends straight distally from the middle of concave section 96 toward distal wall section 102.

Lap receptor 248 may be referred to as a depression in the bottom side 144. The depression extends toward the top side of the base tray 12 or extends toward the desk surface 34. This lap receptor 248 works in combination with the concave section 96 of the base tray and the concave section 42 of the food tray 14. These concave sections 42 need not be concave, but may be merely inwardly extending sections of the proximal sides of the base tray 12 and food tray 14 that extend distally to the distal walls 60 and 102, that provide an ergonomic fit for a child, and that work in combination with the lap receptor 248.

FIG. 7B shows the lap receptor 248 that includes the thigh receptors 252, 254 and dividing wall 256.

FIG. 7B further shows that bottom 144 is retained in and extends into the base tray 12. Base tray 12 is plastic and is preferably injection molded. Base tray 12 is formed of a sheet or layer of plastic such that, for example, there is open space between the outer wall 105 and the inner wall 106 at the right wall 98 of the base tray 12. Likewise, there is open space between the outer wall 105 and the inner wall 106 at the left wall 100 of the base tray 12. Still further, there is open space between the outer wall 105 and the inner wall 106 at the distal wall 102 of the base tray 12. There is further open space between the receptacles 116, 118 and adjacent portions of the outer and inner walls 105, 106. Bottom 144 and the resilient material of bottom 144 may extend upwardly into some or all of these open spaces. For example, as shown in FIG. 7B, the resiliently compressible material of bottom 144 may extend to be adjacent to the underside of the receptacles 116, 118. To provide a more firm desk surface 34, bottom 144 confronts desk surface 34 and extends to make contact with the underside of the desk surface 34. Bottom 144 and the resiliently compressible material of bottom 144 provide a mass to base tray 12 to minimize otherwise excessive flexing of the sheet like base tray 12. This mass provides stability to the food tray 14 or to the base tray 12 when used as a desk without the food tray 14.

Bottom 144 and the resilient material of bottom 144 is contained within the proximal wall 94, distal wall 102, right wall 98 and left wall 100 of the base tray 12. In other words, bottom 144 and the resilient material of bottom 144 is contained within U-shaped wall 105 and the proximal wall 94. U-shaped wall 105 and proximal wall 94 form an inverted receptacle for the inverted base 12 as a whole. In other words, when base tray 12 is turned over and placed on a table such that the desk surface 34 confronts the surface of the table top, U-shaped wall 105 and proximal wall 94 form a receptacle. The resilient material of bottom 144 may fill this receptacle entirely or may fill a portion of the receptacle. The resilient material of bottom 144 runs to and between the proximal wall 94 and distal wall 102 and to and between the right and left walls 98, 100 and confronts the underside of the desk surface 34.

The resilient material of bottom 144 may be a foam material such as a closed cell or open cell foam. The resilient material of bottom 144 may be a pad or cushion or other material that resiliently gives or compresses in response to the pressure of a human hand or of a human finger.

The resilient material of bottom 144 may be a material that forms about the shapes that are found in the base tray 12, such as the receptacles 116, 118. The resilient material of bottom 144 may be a material that is a liquid or gel or other flowing material that flows about the underside of receptacles 116, 118 and into the spaces between the undersides of U-shaped outer wall 105 and undulating inner wall 106 and then sets with time.

Figure 11A:
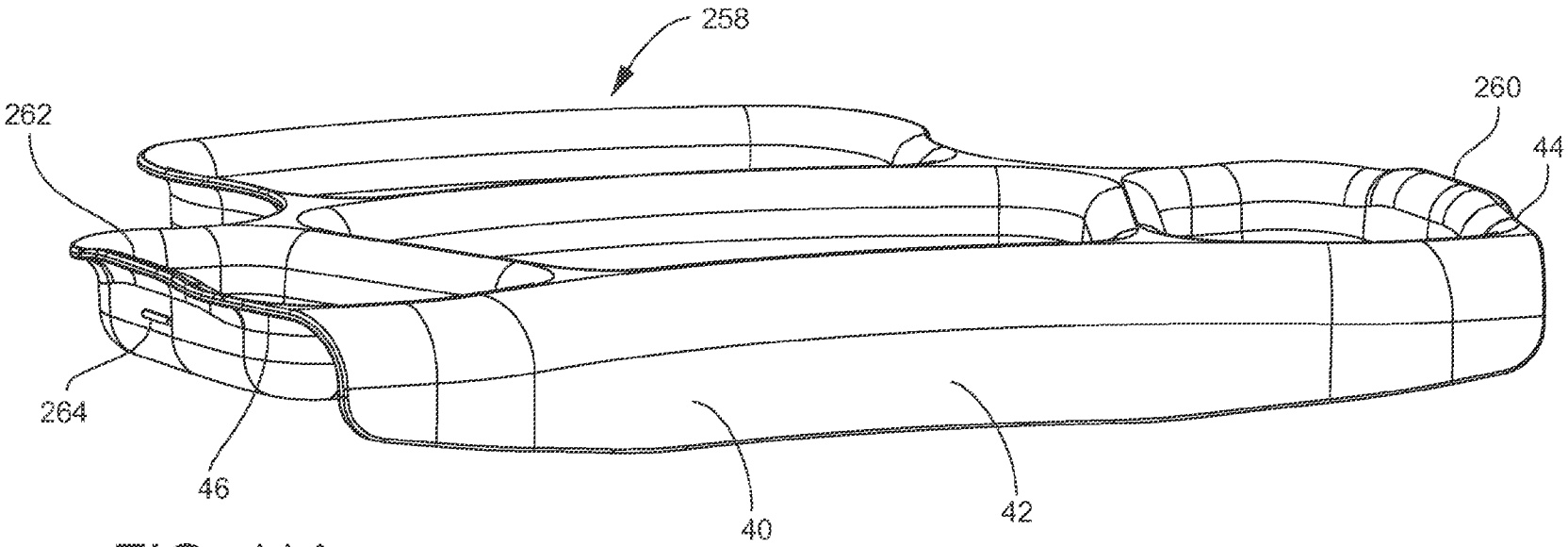
FIG. 11A is a perspective view of an alternate embodiment of the food tray of FIG. 5.
Figure 11B:
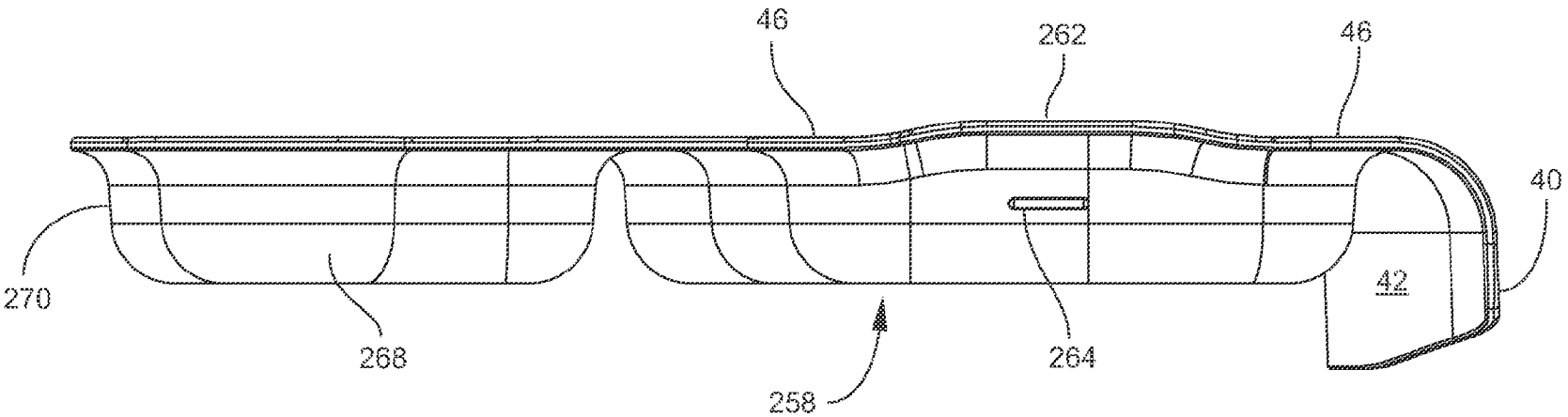
FIG. 11B is a side view of the food tray of FIG. 11A.

FIGS. 11A and 11B show an improved version of the food tray 14, namely, a food tray 258. Food tray 14 is identical to food tray 258 except that the food tray periphery 38 includes right and left raised portions or finger handles 260, 262 along the right and left side portions 44, 46 of the food tray periphery 38. In food tray 14, the right and left side portions 44, 46 hug the top edges of the U-shaped wall 105 closely and make contact with the top edges of the U-shaped wall 105 at right and left wall sections 98, 100. In food tray 258, right and left raised portions 260, 262 are spaced from, and remain adjacent to, top edges of U-shaped wall 105 when the food tray 258 is on the base tray 12. Each of the raised portions 260, 262 includes two tapering sections that lead upwardly into an intermediate section. The intermediate section has a greater height than the tapering sections that in turn have a greater height than the nonraised sections of the right and left side portions 44, 46 of the U-shaped wall 105. The right and left raised portions 260, 262 permit a user to insert his or her fingers or fingertips more readily between the base tray 12 and the food tray 258 such that the user may more easily separate the base tray 12 and food tray 258 from each other.

Each of the food tray 14 and food tray 258 includes a pair of tabs 264. One tab 264 extends from right wall 44. One tab 264 extends from left wall 46. Tab 264 is set approximately midway between top and bottom portions of the tray 14 (or tray 258). Tab 264 is receivable in a tab slot or tab retainer 266 formed on an inner face of the U-shaped wall 105. One tab slot 266 is formed in wall section 98. Another tab slot 266 is formed in wall section 100. Tabs 264 and tab slots 266 are elongate in the proximal to distal direction. Tab retainers 266 are spaced from the upper edge of the wall sections 98, 100. Tab retainers 266 are spaced from the desk surface 34.

In each of the food trays 14 and 258, each of the right and left sidewalls of the distal food compartment 80 has a concave section 268 from the standpoint of side view of FIG. 11B. From the standpoint of FIG. 4, this same concave section 268 is convex. This concave section 268 provides a close, adjacent and nesting fit for receptacles 116, 118 of the base tray 12.

FIG. 11B further shows the S-shape taken by the perimeter of the food trays 14, 258. This S-shape structure runs from a bottom of the compartments 80, 82, 84 to the top or top lip of the food trays, 14, 258. For example, reference number 270 designates an S-shaped structure. This S-shaped structure of the perimeter of the food trays 14, 258 nestles into an S-shaped structure formed by inner wall 106 of base tray 12. The portions of the base tray 12 forming this S-shaped structure are first, second, and third features, where the first feature is the radius or curved junction between the desk surface 34 and the inner wall 106, where the second feature is a radius or curved top formed on the top of inner wall 106, and where the third feature is a transition between the first and second features and formed on an intermediate portion of the inner wall 106. These adjacent S-shaped structures are shown in the section view of FIG. 7B. The S-shaped structure is continuous about the inner wall 106. The S-shaped structure is discontinuous about the perimeter of the food trays 14, 258. For example, the outer and distal walls of food compartment 82 have the S-structure and mate with the inner wall 106. The right and left walls, or outer walls, of food compartment 80 have the S-structure and mate with inner wall 106. The distal and left walls of food compartment 84 have the S-structure and mate with inner wall 106. The S-structure is discontinuous between the distal wall of food compartment 82 and the right wall of food compartment 80. The S-structure is discontinuous between the left wall of food compartment 80 and the distal wall of food compartment 84.

FIG. 11B further shows the concavity of the concave or arcuate section 42 of food trays 14, 258. Concave section 42 extends distally to a point beyond a proximal portion of the proximal sidewall of food compartments 82, 84.

FIG. 11B further shows that the entire proximal lip or wall 40 of each of the trays 14, 258 has a greater height, or extends to a greater depth, than the floors of each of the food compartments 78, 80, 82, 84. Proximal lip or wall 40 includes the concave section 42. The floors of the food compartments 78, 80, 82, 84 rest upon the desk surface 34. The proximal edge of the desk surface 34 is closed off by the proximal lip or wall 40.

In operation, as shown in FIG. 1, the tray apparatus 10 may be carried on a shoulder of a caregiver. Base connector 176 is normally engaged to the strap apparatus 16, not the base tray 12, even though the base connector 176 is shown in FIGS. 4, 5, 6, 7A, 7B, and 8 apart from the remaining portions of the strap apparatus 16. Base connector 176 is a quick connect. A caretaker may feed the headed pin 178 of the base connector 176 of strap unit 182 into the keyhole opening or connection 174. The headed pin 178 is first fed into the larger opening of the keyhole connection 174 and then snapped into the smaller opening of the keyhole connection 174. Then the caretaker connects the other strap unit 183 to the other keyhole connection 174. Then the caretaker connects loop fabric fastener 194 of strap unit 182 to hook fabric fastener 196 of strap unit 183 to form the U-shape to the strap apparatus 16. Then the caretaker may adjust the length of one or more of the strap units 182, 183 by sliding the slide buckle 190. Then the caretaker may carry the tray apparatus 10, including the base tray 12 and one of the food trays 14, 258, over his or her shoulder or in another manner. The above steps may take place in any order. When being carried in a vertically oriented position such as shown in FIG. 1, the food tray 14 or 258 remains in the base tray 12 by virtue of one or more of a) the connection between the tab 264 and slot 266, b) the neck 66 and head 68 of the tray 14 or 258 being captured by the inner wall 106 of the base tray 12, c) the seating of the S-shaped walls of the tray periphery 38 upon the S-shaped wall of the inner wall 106 of the base tray 12, and d) and a friction fit between the proximal wall or lip 40 of the food tray 14, 258 with the proximal wall 94 of the base tray 12 where such friction fit between the proximal walls 40 and 94 takes place because the head 68 of the tray 14 or 258 restricts the sliding of the food tray 14 or 258 along the plane of the desk surface 34. Lids 146 remain in their respective receptacles 116, 118 even when the tray apparatus 10 is in the vertically oriented position because of the friction fit between lid 146 and its respective receptacle 116, 118.

In operation, as shown in FIG. 2, the food tray 14 or 258 is on the base tray 12. The food tray 14 or 258 is placed on the base tray 12 from above. If the food tray 14 or 258 defines a plane and the base tray 12 defines a plane, then the final action to bring the base tray 12 and food tray 14, 258 together is at a right angle to the planes. However, prior to this final action, food tray 14 or 258 may be slid on top of the base tray 12 until the food tray 14 or 258 naturally seeks its seat in the base tray 12. This natural seating occurs because of one or more of the following features: a) the inner wall 106 is tailored to the shape of the perimeter 38 of the food tray 14 or 258 where each of the base tray 12 and food tray 14, 258 includes a cloverleaf shape having three projections, b) the proximal walls 40, 94 are tailored to run parallel to each other, c) the S-shaped structure of right or outer wall of food compartment 82 along with the S-shaped structure of left or outer wall 84 of food compartment 84 forms generally a V-shape that naturally seeks the V-shaped structure formed by the combination of the inner faces of base walls 98, 100 where these inner faces form part of the inner wall 106, d) the S-shaped structure of the right or outer wall of food compartment 80 along with the S-shaped structure of the left or other outer wall of food compartment 80 forms generally a V-shaped that naturally seeks the V-shaped structure formed by the combination of the faces of the inner wall 106 about the receptacles 116, 118, and e)

the radius or curvature of the upper edges of the inner wall 106 naturally permits a sliding down of the food tray 14 or 258 because of the radius or curvature between the floors of the food compartments and the walls of the food compartments, namely, the curvature or radius found between the outer and distal walls and floor of food compartment 82, the distal wall and both outer walls and floor of food compartment 80, and the outer and distal walls and floor of food compartment 84.

After the food tray 14 or 258 is seated in the base tray 12, food may be placed in one or more of the food compartments 78, 80, 82 and 84 and drinks may be placed in receptacles 116, 118 with or without lids 146. During the time the child is eating, the food tray 14 or 258 does not slip relative to the base tray 12 because of one or more of the following features: a) the connection between the tab 264 and slot 266, b) the neck 66 and head 68 of the tray 14 or 258 being captured by the inner wall 106 of the base tray 12, c) the seating of the S-shaped walls of the tray periphery 38 upon the S-shaped wall of the inner wall 106 of the base tray 12, and d) and a friction fit between the proximal wall or lip 40 of the food tray 14, 258 with the proximal wall 94 of the base tray 12 where such friction fit between the proximal walls 40 and 94 takes place because the head 68 of the tray 14 or 258 restricts the sliding of the food tray 14 or 258 along the plane of the desk surface 34. When the child is eating, the inwardly extending proximal wall 40 of tray 14 or 258 and the inwardly extending proximal wall 94 of the base tray 12 permit the tray apparatus 10 to be hugged about the child's torso, midsection or stomach. After the child has finished eating, the food tray 14 or 258 may be removed from the base tray 12 by lifting up on the finger handles 260, 262. The food tray 14 or 258 may then be washed in the dishwasher.

In operation, the base tray 12 may operate as a desk. With the exception of groove 170 intended for holding a writing utensil such as a pen or pencil, the desk surface 34 is flat and smooth such that any writing or drawing that takes place on the surface encounters no bumps or roughness. The desk surface 34 is readily available to the human arm, hand, wrist and forearm because of the desk opening 113. A forearm or arm or hand or wrist may lay flat on the desk surface 34 and extend off the desk surface 34 without encountering an upward extension because of the desk opening 113. The receptacles 116, 118 may contain writing utensils 36 with or without lids 146. With lids 146, the writing utensil 36 may be inserted into the slots between the petals 152 and frictionally held therein by the edges of the resilient petals 152. The food tray 14 or 258 is independent of the receptacles 116, 118 such that the food tray 14 or 258 may be removed from the base tray 12 and, at the same time, a drinking glass or cup may remain in the receptacle 116, 118 while the child uses the desk surface 34 to write or draw.

In operation, the strap apparatus 16 may be used whether the base tray 12 is being employed a) with the food tray 14 or 258 or b) without the food tray 14 or 258, i.e., as a desk where the desk surface 34 is utilized. When the food tray 14 or 258 is on the base tray 12, the keyhole connection 174 is accessible. The food tray 14 or 258 does not cover the keyhole connection 174. The base connector 176 of each of the strap units 182, 183 is snapped in keyhole connection 174, the slide buckle 190 is employed to shorten or length the desired length of the respective strap unit 182, 183, and then the clip 192 is clamped to a portion of a car seat or a portion of a chair.

Even without the strap apparatus 16, the base tray 12 is configured to remain stable and secure on the lap or legs of a child. Features that contribute here are: 1) the lap receptor 248 and thigh receptors 252, 254, 2) the inwardly extending proximal wall 40 of the tray 14 or 258, 3) the inwardly extending proximal wall 94 of the base 12, and 4) the nonslip material of the bottom 144 where the bottom 144 is also a cushion or pad formed of a resiliently compressible material.

The base tray 12 may be used stably and securely on a horizontal surface such as a table top. The U-shaped surface portion 246 is the portion of the bottom 144 that lies on the horizontal surface and provides stability to the trap apparatus 10. The nonslip material of the bottom 144 keeps the base tray 12, with or without the food tray 14 or 258, at one location on the horizontal surface.

The base tray 12 may be injection molded. The tray 14 or 258 may be injection molded. The material making up bottom side 144 may be a polyurethane foam.

Tray apparatus 10 may include a color scheme. For example, the bottom side 144 may be a first color or shade of color. Bottom side 144 is preferably blue or a shade of blue. The strap apparatus 16, including one or more of the base connectors 176, straps 184, slide buckles 190, clips 192 and hook and loop fabric fasteners 194, 196, may be a second color or shade of color. Strap 184 and clips 192 are preferably blue or a shade of blue. The base tray 12 may be a third color or shade of color. Base tray 12 is preferably white or a shade of white. The food tray 14 or 258 may be a fourth color. Food tray 14 or 258 may be green or a shade of green. The cup holder lids 146 may be a fifth color or shade of color. Cup holder lids 146 may be blue or translucent blue or a shade of blue.

Each of the proximal wall 94, distal wall 102, right wall 98 and left wall 100 run downwardly relative to the desk surface 34 of the top side of the base tray 12 and form an open bottom 144 that receives the resilient material. The first receptacle 116 (or 118) depends into the resilient material. The desk surface 34 includes a desk surface portion. The desk surface portion includes a central portion spaced from the proximal, distal, right, and left sides of the base tray 12. The desk surface portion further runs from the central portion to the proximal, right and left sides of the base tray 12. The desk surface portion is smooth. Lip 39 of the food tray 14 is seated by the undulating inner wall 106 of the base tray 12 having the same horizontal undulations. A horizontal width of the neck of the base tray 12 is defined by a first distance from a first location on the right side of inner wall 106 to a first location on the left side of inner wall 106. A horizontal width of the head of the base tray 12 is defined by a second distance from a second location on the right side of inner wall 106 to a second location on the left side of inner wall 106. The second distance is greater than the first distance. The neck 66 and head 68 of the food tray 14 has a complementary structure to the neck and head of the base tray 12 such that the neck 66 and head 68 of the food tray 14 nests into the neck and head of the base tray 12 such that the food tray 14 is locked against horizontal sliding relative to the base tray 12 when the food tray 14 dovetails with the base tray 12.

Thus since the invention disclosed herein may be embodied in other specific forms without departing from the spirit or general characteristics thereof, some of which forms have been indicated, the embodiments described herein are to be considered in all respects illustrative and not restrictive. The scope of the invention is to be indicated by the appended claims, rather than by the foregoing description, and all changes which come within the meaning and range of equivalents of the claims are intended to be embraced therein.

What is claimed is:

1. A two-part lap tray apparatus comprising:

a) a base tray as a first part and a food tray as a second part;

b) the base tray comprising a proximal side, a distal side opposing the proximal side, a left side, a right side opposing the left side, a top side, and a bottom side;

c) the top side of the base tray comprising a desk surface extending generally between the proximal and distal sides and between the right and left sides;

d) the food tray covering a portion of the top side of the base tray and being engagable to and disengagable from the base tray, the food tray comprising at least two compartments separated from each other by an inner wall, each of the compartments having a depth;

e) the bottom side of the base tray comprising a resilient material to fit on a lap of a child, the resilient material being resiliently compressible by a human hand;

f) wherein the top side of the base tray is formed of a layer of plastic material, the plastic material being noncompressible by a human hand;

g) wherein the layer of plastic material includes a proximal wall, a distal wall, a right wall, and a left wall, the resilient material running to and between the proximal and distal walls and to and between the right and left walls;

h) each of the proximal wall, distal wall, right wall and left wall running downwardly relative to the desk surface of the top side of the base tray and forming an open bottom that receives the resilient material;

i) wherein the resilient material confronts the desk surface from below to provide support thereto;

j) wherein the base tray further comprises a first receptacle, the first receptacle being separated from the desk surface by a first receptacle wall, the first receptacle having a depth, the first receptacle depending into the resilient material;

k) wherein the top side of the base tray and the bottom side of the base tray, including the resilient material of the base tray, are one-piece with each other and are not separable from each other without destroying an integrity of the base tray;

l) the desk surface having a desk surface portion, the desk surface portion having a central portion spaced from the proximal, distal, right, and left sides, the desk surface portion further running from the central portion to the proximal, right and left sides; and m) wherein the base tray includes a base tray outer periphery;

n) wherein the base tray includes a second receptacle, the second receptacle depending into the resilient material;

o) wherein the food tray includes a food tray outer periphery, the food tray outer periphery undulating inwardly of the base tray outer periphery to expose to view and permit access to each of said first and second receptacles when the food tray is engaged to the base tray.

2. The two-part lap tray apparatus of claim 1, wherein the resilient material on the bottom side of the base tray includes a depression to receive a lap of a child, the depression extending toward the top side of the base tray.

3. The two-part lap tray apparatus of claim 1, wherein the food tray includes a proximal side and a distal side, wherein each of the proximal sides of the base tray and food tray includes an inwardly extending section for an ergonomic fit for a child, the inwardly extending section of the base tray extending toward the distal side of the base tray, the inwardly extending section of the food tray extending toward the distal side of the food tray.

4. The two-part lap tray apparatus of claim 1, wherein the desk surface is defined by an upwardly extending first wall running along at least a portion of the left side, at least a portion of the right side, and at least a portion of the distal side, the first wall having a desk opening along the proximal side such that the desk surface is open along at least a portion of the proximal side to render the desk surface accessible to hands and forearms of a user.

5. A two-part lap tray apparatus comprising:

a) a base tray as a first part and a food tray as a second part;

b) the base tray comprising a proximal side, a distal side opposing the proximal side, a left side, a right side opposing the left side, a top side, and a bottom side;

c) the base tray further comprising a desk surface, the desk surface defined by an upwardly extending first wall running along at least a portion of the left side, at least a portion of the right side, and at least a portion of the distal side, the proximal side of the base tray further comprising a downwardly extending second wall, the first wall and the second wall defining a desk opening along the proximal side such that the desk surface is open along at least a portion of the proximal side to render the desk surface accessible for hands and forearms of a user;

d) the food tray covering at least a portion of the top side of the base tray, the food tray comprising at least two compartments separated from each other by an inner wall, each of the compartments having a depth;

e) the food tray further comprising a proximal wall confronting the proximal side of the base tray, the proximal wall of the food tray closing off at least a portion of the desk opening to minimize contents of the food tray from spilling out of the food tray and onto a lap of a child;

f) the desk surface having a desk surface portion, the desk surface portion having a central portion spaced from the proximal, distal, right, and left sides, the desk surface portion further running from the central portion to the proximal, right and left sides;

g) wherein the second wall of the base tray and the desk surface of the base tray form a junction, a depth of the junction being at or greater than a depth of the desk surface such that the desk surface leads down into the second wall of the base tray; and h) wherein when the food tray is engaged to the base tray, the proximal wall of the food tray extends vertically from a top of the first wall of the base tray towards a bottom of the base tray, a lowermost edge of the proximal wall of the food tray being disposed at a depth greater than the depth of the desk surface and confronting the junction between the second wall of the base tray and the desk surface of the base tray.

6. The two-part lap tray apparatus of claim 5, wherein the base tray includes a receptacle, the receptacle being separated from the desk surface by a receptacle wall, the receptacle having a receptacle opening that remains accessible when the food tray is on the base tray.

7. The two-part lap tray apparatus of claim 6, wherein the receptacle includes a depth, the depth of the receptacle being greater than the depth of the desk surface.

8. A two-part lap tray apparatus comprising:

a) a base tray as a first part and a food tray as a second part;

b) the base tray comprising a proximal side, a distal side opposing the proximal side, a left side, a right side opposing the left side, a top side, and a bottom side;

c) the base tray further comprising a desk surface on the top side, the desk surface defined by an upwardly extending first wall running along at least a portion of the left side, at least a portion of the right side, and at least a portion of the distal side, the proximal side of the base tray further comprising a downwardly extending second wall, the first wall and the second wall defining a desk opening along the proximal side such that the desk surface is open along at least a portion of the proximal side of the base tray to render the desk surface accessible for hands and forearms of a user when the food tray is not engaged to the base tray, the desk surface having a depth relative to a top of the first wall, the first wall undulating horizontally;

d) the base tray further comprising a first receptacle, the first receptacle being separated from the desk surface by a first receptacle wall, the first receptacle having a depth relative to the top of the first wall, the depth of the first receptacle being greater than the depth of the desk surface;

e) the base tray further comprising a second receptacle, the second receptacle being separated from the desk surface by a second receptacle wall, the second receptacle having a depth relative to the top of the first wall, the depth of the second receptacle being greater than the depth of the desk surface;

f) the food tray covering at least a portion of the top side of the base tray, the food tray comprising at least two compartments separated from each other by an inner wall, each of the compartments having a depth;

g) the food tray further comprising a peripheral lip extending about a periphery of the food tray, the peripheral lip running adjacent to at least a portion of the first wall on the left side of the base tray, at least a portion of the first receptacle wall of the base tray, at least a portion of the first wall on the distal side of the base tray, at least a portion of the second receptacle wall of the base tray, at least a portion of the first wall on the right side of the base tray, and said portion of the proximal side of the base tray;

h) wherein the peripheral lip of the food tray runs sequentially from said portion of the first wall on the left side of the base tray, to said portion of the first receptacle wall of the base tray, to said portion of the first wall on the distal side of the base tray, to said portion of the second receptacle wall of the base tray, to said portion of the first wall on the right side of the base tray, to said portion of the proximal side of the base tray, and back to said portion of the first wall on the left side of the base tray;

i) the peripheral lip of the food tray undulating in a horizontal manner such that said undulating of the peripheral lip follows said undulating of the first wall of the base tray;

j) such that the first and second receptacles remain exposed and accessible for use when the food tray is on the base tray;

k) the peripheral lip of the food tray further comprising a proximal wall confronting the proximal side of the base tray, the proximal wall of the food tray closing off at least a portion of the desk opening when the food tray is engaged to the base tray to minimize contents of the food tray from spilling out of the food tray and onto a lap of a child;

l) wherein the second wall of the base tray and the desk surface of the base tray form a junction, a depth of the junction being at or greater than the depth of the desk surface such that the desk surface leads down into the second wall of the base tray and such that the desk surface is open along the portion of the proximal side of the base tray to render the desk surface accessible for hands and forearms of a user when the food tray is not engaged to the base tray; and m) wherein when the food tray is engaged to the base tray, the proximal wall of the food tray extends vertically from the top of the first wall of the base tray towards a bottom of the base tray, a lowermost edge of the proximal wall of the food tray being disposed at a depth greater than the depth of the desk surface and confronting the junction between the second wall of the base tray and the desk surface of the base tray.

9. The two-part lap tray apparatus of claim 8, wherein the food tray includes two more compartments such that the food tray in total includes first, second, third and fourth compartments, each of the first, second, third and fourth compartments having a depth, the first compartment being between the first and second receptacles and further being between the second compartment and the distal side of the base tray when the food tray is in the base tray, the second compartment being between the first compartment and the proximal side of the base and further being between the third and fourth compartment when the food tray is in the base tray, the third compartment being between the first receptacle and the proximal side of the base tray and further being between the first wall of the base tray and the second compartment when the food tray is in the base tray, and the fourth compartment being between the second receptacle and the proximal side of the base tray and further being between the first wall of the base tray and the second compartment when the food tray is in the base tray.

* * * * *